US012349761B2

(12) United States Patent
Andreasen et al.

(10) Patent No.: US 12,349,761 B2
(45) Date of Patent: Jul. 8, 2025

(54) ARTICLE OF FOOTWEAR HAVING A SOLE STRUCTURE

(71) Applicant: NIKE, Inc., Beaverton, OR (US)

(72) Inventors: Lindsey Kirsten Andreasen, Beaverton, OR (US); Nathan Durflinger, Beaverton, OR (US); Eric Fauble, Portland, OR (US); Jun Peng, Portland, OR (US); Evan Perkins, Portland, OR (US); Jessica Small, Portland, OR (US)

(73) Assignee: NIKE, INC., Beaverton, OR (US)

( * ) Notice: Subject to any disclaimer, the term of this patent is extended or adjusted under 35 U.S.C. 154(b) by 164 days.

(21) Appl. No.: 18/063,775

(22) Filed: Dec. 9, 2022

(65) Prior Publication Data

US 2023/0189925 A1 Jun. 22, 2023

Related U.S. Application Data

(60) Provisional application No. 63/290,236, filed on Dec. 16, 2021.

(51) Int. Cl.
*A43B 13/20* (2006.01)
*A43B 13/12* (2006.01)

(52) U.S. Cl.
CPC ..... *A43B 13/20* (2013.01); *A43B 13/12* (2013.01)

(58) Field of Classification Search
None
See application file for complete search history.

(56) References Cited

U.S. PATENT DOCUMENTS

| | | | | |
|---|---|---|---|---|
| 5,025,575 A | | 6/1991 | Lakic | |
| 5,117,566 A | * | 6/1992 | Lloyd | A43B 13/206 36/28 |
| 5,343,639 A | * | 9/1994 | Kilgore | A43B 13/183 36/35 B |
| 6,782,641 B2 | * | 8/2004 | Turner | A43B 13/12 36/35 B |
| 6,865,824 B2 | * | 3/2005 | Levert | A43B 13/182 36/35 B |
| 7,398,608 B2 | * | 7/2008 | Schoenborn | A43B 13/143 36/28 |
| 7,513,065 B2 | * | 4/2009 | Kita | A43C 15/168 36/27 |

(Continued)

FOREIGN PATENT DOCUMENTS

EP 0751722 B1 5/1999

OTHER PUBLICATIONS

International Search Report in PCT/US2022/081235, dated Jun. 5, 2023 (6 pages).

*Primary Examiner* — Jila M Mohandesi
(74) *Attorney, Agent, or Firm* — Bookoff McAndrews, PLLC

(57) ABSTRACT

A sole structure for an article of footwear including a forefoot region disposed adjacent an anterior end, a heel region disposed adjacent a posterior end, a bottom cushion extending from the heel region to the forefoot region, a heel cushion coupled to a top surface of the bottom cushion in the heel region, and a support plate coupled to a top surface of the heel cushion in the heel region. The sole structure further includes a top surface of the bottom cushion in the forefoot region and a top cushion coupled to a top surface of the support plate.

23 Claims, 17 Drawing Sheets

(56) References Cited

U.S. PATENT DOCUMENTS

| | | | | |
|---|---|---|---|---|
| 7,886,460 | B2 * | 2/2011 | Teteriatnikov | A43B 13/145 36/31 |
| 2002/0050077 | A1 * | 5/2002 | Wang | A43B 1/0072 36/15 |
| 2006/0201029 | A1 * | 9/2006 | Dojan | A43B 21/28 36/29 |
| 2007/0101617 | A1 * | 5/2007 | Brewer | A43B 7/08 36/103 |
| 2009/0056165 | A1 * | 3/2009 | Lee | A43B 13/12 36/108 |
| 2009/0151093 | A1 | 6/2009 | Schindler et al. | |
| 2017/0095034 | A1 | 4/2017 | Dupre et al. | |
| 2020/0297071 | A1 * | 9/2020 | Troufanov | A43B 13/189 |
| 2021/0204651 | A1 | 7/2021 | Thompson et al. | |
| 2021/0368918 | A1 | 12/2021 | Lyke | |
| 2022/0378148 | A1 | 12/2022 | Eldem et al. | |

* cited by examiner

ARTICLE OF FOOTWEAR HAVING A SOLE STRUCTURE

CROSS-REFERENCE TO RELATED APPLICATION(S)

This application claims priority to U.S. Provisional Application No. 63/290,236, filed Dec. 16, 2021, the entirety of which is incorporated herein by reference.

TECHNICAL FIELD

The present disclosure relates generally to sole structures for articles of footwear, and more particularly, to sole structures incorporating a stacked structure and a bladder.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load.

SUMMARY

Examples of the present disclosure relate to, among other things, articles of footwear having a sole structure. In one example, the articles of footwear may be worn for an extended period of time. Each of the examples disclosed herein may include one or more of the features described in connection with any of the other disclosed examples.

BRIEF DESCRIPTION OF THE DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
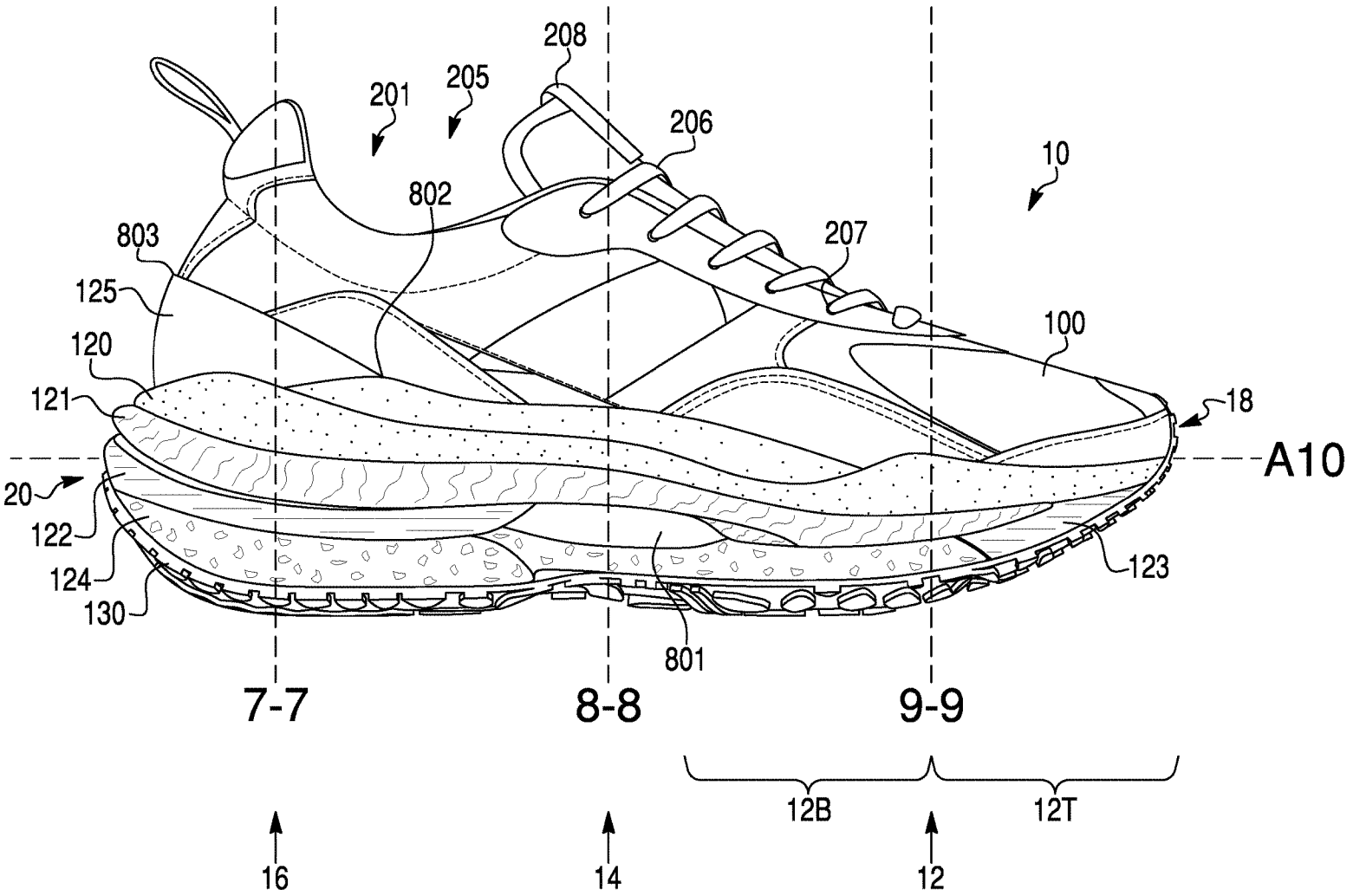
FIG. 1 illustrates an exemplary article of footwear including a sole structure, according to an embodiment of the disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 2:
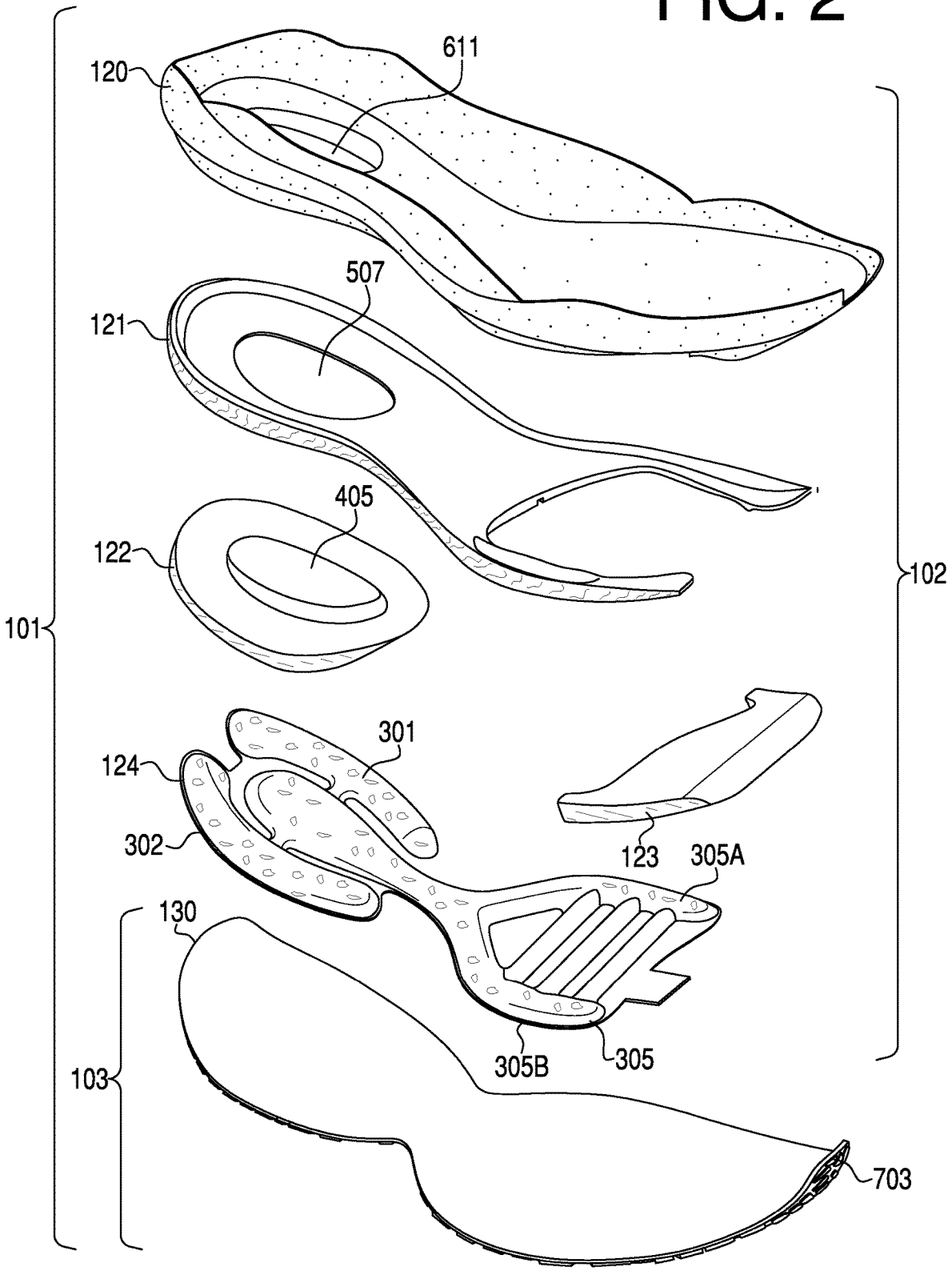
FIG. 2 illustrates an exploded view of the sole structure of the article of footwear of FIG. 1.
Figure 10:
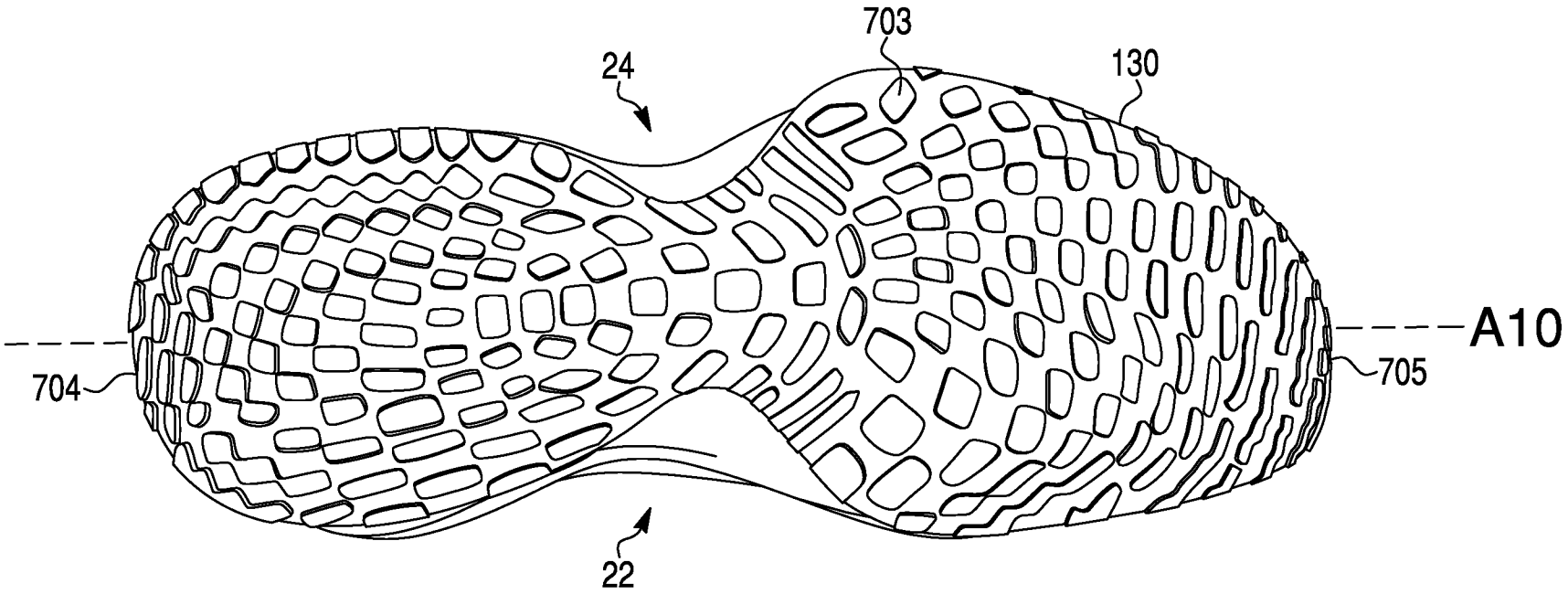
FIG. 10 illustrates a bottom view of the sole structure of the article of footwear of FIG. 1.

FIG. 1 depicts an article of footwear 10 including a sole structure 101 and an upper 100 attached to the sole structure 101 (shown in FIG. 2). The article of footwear 10 may be divided into one or more regions. The regions may include a forefoot region 12, a mid-foot region 14, and a heel region 16. The forefoot region 12 may be further described as including a toe portion 12T corresponding to the phalanges of the foot, and a ball portion 12B corresponding to a metatarsophalangeal (MTP) joint. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis A10 of the footwear 10 extends along a length of the footwear 10 from the anterior end 18 to the posterior end 20, and generally divides the footwear 10 into a medial side 22 and a lateral side 24, as shown in FIG. 10. Accordingly, the medial side 22 and the lateral side 24 respectively correspond with opposite sides of the footwear 10 and extend through the regions 12, 14, 16.

Upper

Referring to FIG. 2, the upper 100 includes interior surfaces that define an interior void 201 configured to receive and secure a foot for support on sole structure 101. The upper 100 may be formed from one or more materials that are stitched or adhesively bonded together to form the interior void 201. Suitable materials of the upper may include, but are not limited to, mesh, textiles, foam, leather, and synthetic leather. The materials may be selected and located to impart properties of durability, air-permeability, wear-resistance, flexibility, and comfort.

With reference to FIG. 2, in some examples the upper 100 includes a strobel 202 having a bottom surface opposing the sole structure 101 and an opposing top surface defining a footbed of the interior void 201. Stitching or adhesives may secure the strobel to the upper 100. The footbed may be contoured to conform to a profile of the bottom surface (e.g., plantar) of the foot. Optionally, the upper 100 may also incorporate additional layers such as an insole or sockliner that may be disposed upon the strobel and reside within the interior void 201 of the upper 100 to receive a plantar surface of the foot to enhance the comfort of the article of footwear 10. An ankle opening 205 in the heel region 16 may provide access to the interior void 201. For example, the ankle opening 205 may receive a foot to secure the foot within the void 201 and to facilitate entry and removal of the foot from and to the interior void 201.

In some examples, one or more fasteners 206 extend along the upper 100 to adjust a fit of the interior void 201 around the foot and to accommodate entry and removal of the foot therefrom. The upper 100 may include apertures 207 such as eyelets and/or other engagement features such as fabric or mesh loops that receive the fasteners 206. The fasteners 206 may include laces, straps, cords, hook-and-loop, or any other suitable type of fastener. The upper 100 may include a tongue portion 208 that extends between the interior void 201 and the fasteners 206.

With reference to FIG. 2, the sole structure 101 includes a midsole 102 configured to provide cushioning and performance characteristics to the sole structure 101, and an outsole 103 configured to provide a ground-engaging surface of the article of footwear 10. Unlike conventional sole structures, the midsole 102 of the sole structure 101 may be formed compositely and include a plurality of subcomponents for providing desired forms of cushioning and support throughout the sole structure 101. For example, the midsole 102 may include an upper cushioning element (or top cushion) 120, a support plate 121, a heel cushioning element (or heel cushion) 122, a forefoot cushioning element 123, and a bladder (or cushioning element/bottom cushion) 124. The upper cushioning element 120 may be disposed on a top side of the plate 121, and the heel cushioning element 122 may engage with a heel region of the plate 121. The bladder 124 may be disposed on a bottom side of the heel cushioning element 122 in a heel region 16, and a bottom side of the plate 121 in a forefoot region of the plate 121. The outsole 103 includes a mold 130, defining a ground-contacting (or ground-engaging) surface. The outsole 103 may be configured to receive the bladder 124 at a top surface of the outsole. Each of these components will be described in further detail below.

Bladder (Cushioning Element)

Figure 3:
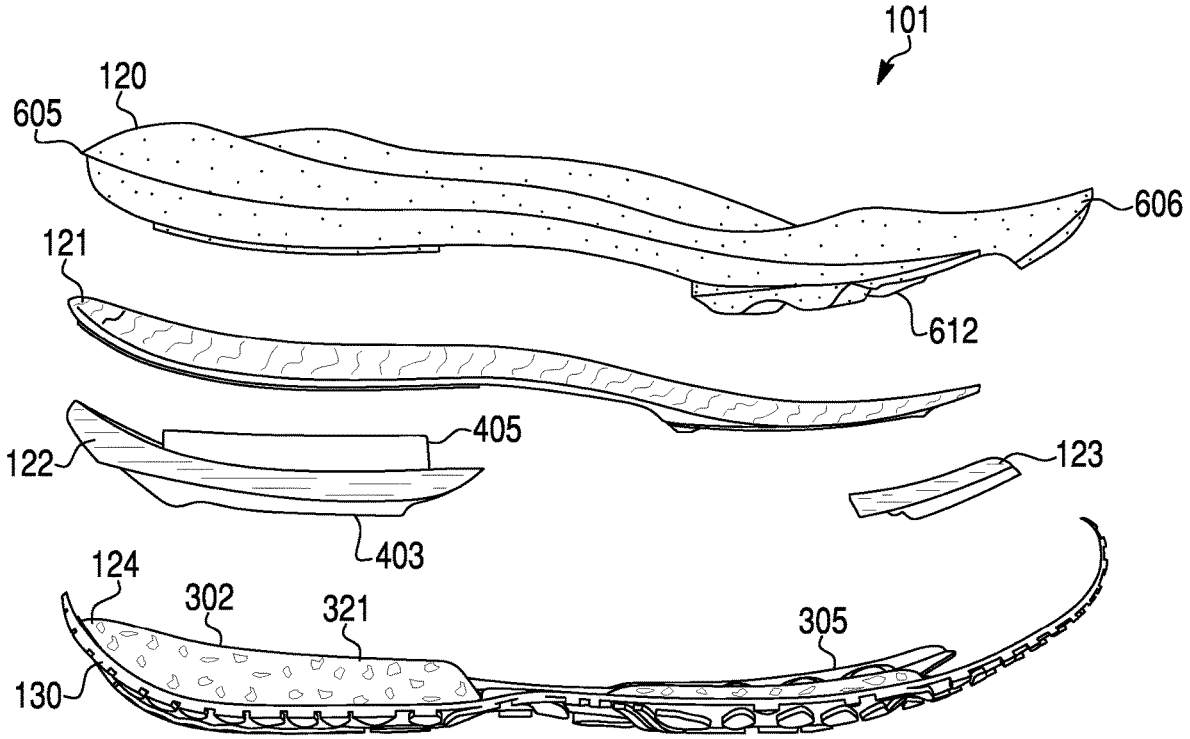
FIG. 3 illustrates a partially exploded view of the sole structure of the article of footwear of FIG. 1.
Figure 3A:
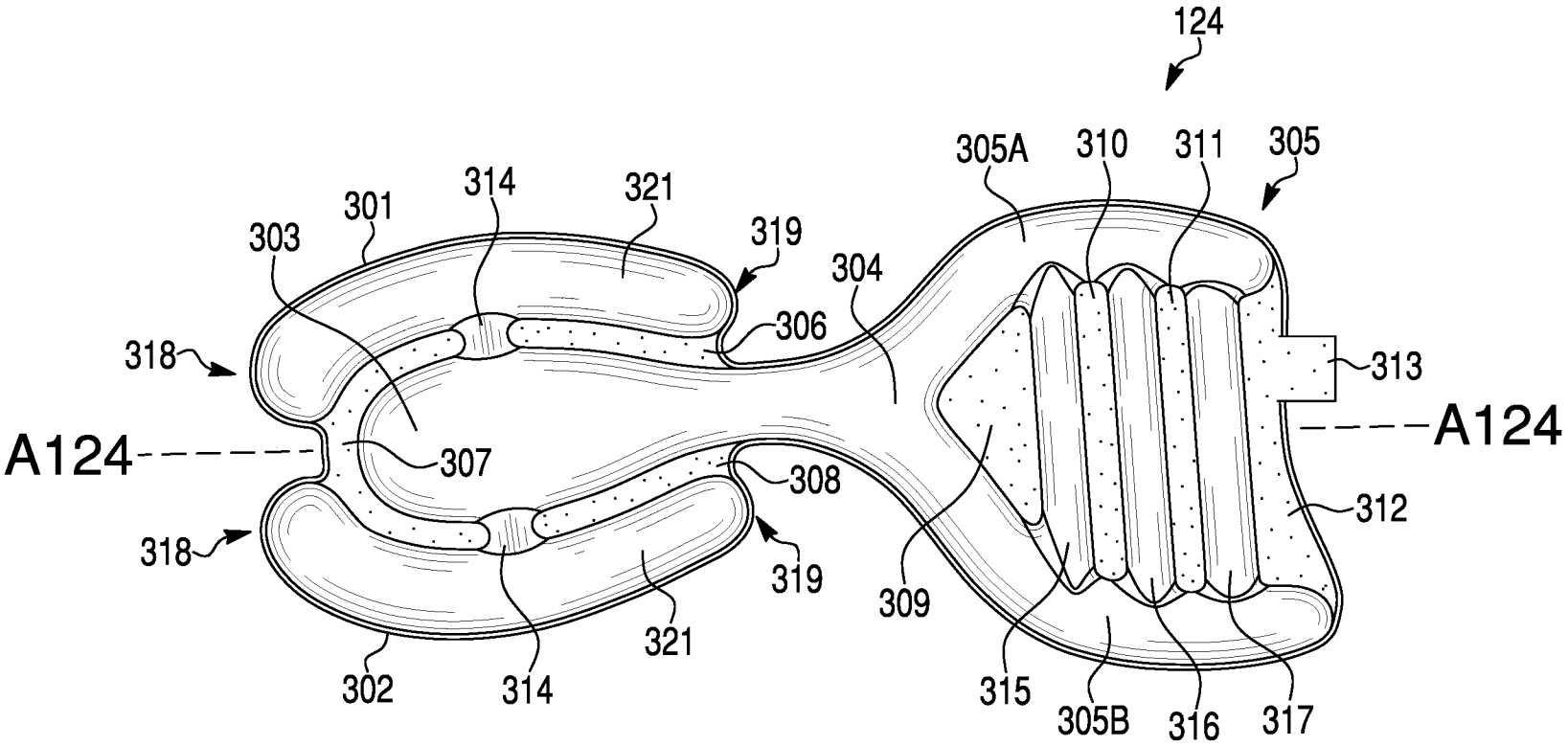
FIG. 3*a* illustrates a top-down view of a fluid-filled bladder of the sole structure of the article of footwear of FIG. 1.
Figure 3B:
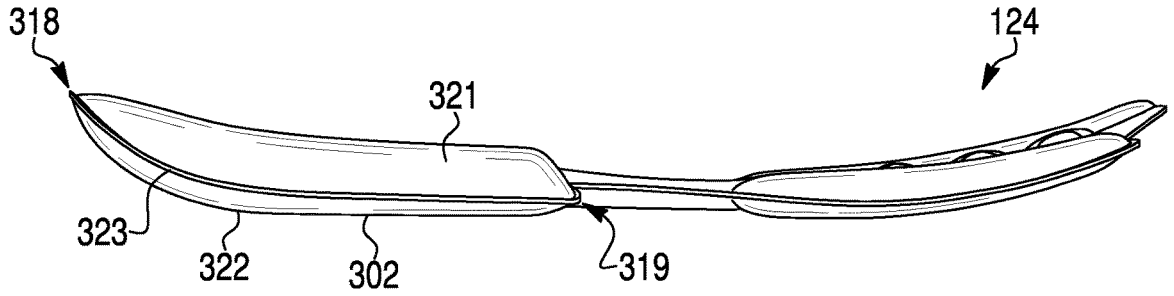
FIG. 3*b* illustrates a perspective view of a fluid-filled bladder of the sole structure of the article of footwear of FIG. 1.
Figure 3C:
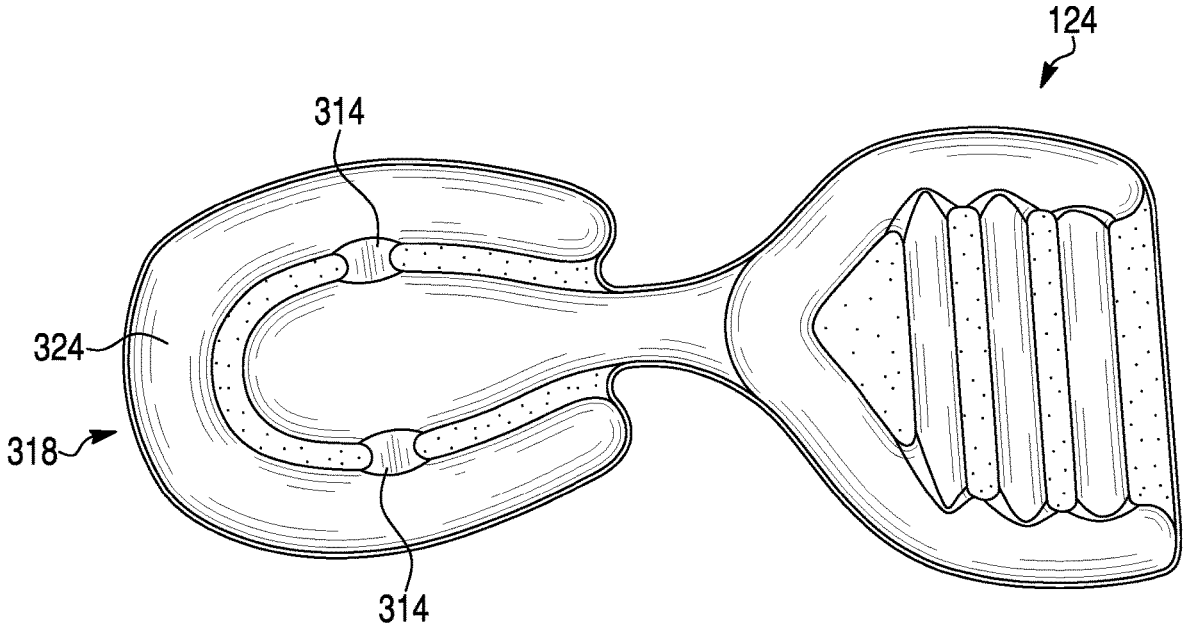
FIG. 3*c* illustrates a top-down view of an alternative embodiment of a fluid-filled bladder of the sole structure of the article of footwear of FIG. 1.

Referring to FIGS. 3A-3C, the bladder 124 may be a fluid-filled bladder, for example, that may be inflated to provide a desired form of cushioning and support. Bladder 124 may be formed from a pair of barrier layers, which when joined together may define an enclosed inner volume (or hollow interior) 325 (FIGS. 7-9) for receiving, for example, a pressurized fluid (e.g. a gas as set forth in further detail below). The barrier layers may be joined to each other at discrete locations to define an overall shape of the bladder 124. The barrier layers may include an upper, first barrier layer (or upper surface) 321 and a lower, second barrier layer 322 (see FIG. 3B). The first barrier layer 321 and the second barrier layer 322 define barrier layers for the bladder 124 by joining together and bonding at a plurality of discrete locations during a molding or thermoforming process. Accordingly, the first barrier layer 321 is joined to the second barrier layer 322 to form a seam 323 (see FIG. 3B) extending around the periphery of the bladder 124. First barrier layer 321 and second barrier layer 322 also form a web area. The web area may be divided into a plurality of sections 306-312 that are separated from one another by various structures. The first barrier layer 321 and the second barrier layer 322 may each be formed from a sheet of transparent, thermoplastic polyurethane (TPU). In some examples, the barrier layers 321 and 322 may be formed of non-transparent polymeric materials. Alternatively, the bladder 124 may be produced from any suitable combination of one or more barrier layers. As used herein, the term "barrier layer" (e.g., barrier layers 321 and 322) encompasses both monolayer and multilayer films. In some embodiments, one or both of the barrier layers 321 and 322 are each produced (e.g., thermoformed or blow molded) from a monolayer film (a single layer). In other embodiments, one or both of the barrier layers 321 and 322 are each produced (e.g., thermoformed or blow molded) from a multilayer film (multiple sublayers). In either aspect, each layer or sublayer may have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

The first and second barrier layers 321 and 322 may, for example, be formed by respective mold portions each defining various surfaces for forming depressions and pinched surfaces corresponding to locations where the seam 323 and/or the web area are formed when the second barrier layer 322 and the first barrier layer 321 are joined and bonded together. In some implementations, adhesive bonding joins the first barrier layer 321 and the second barrier layer 322 to form the bladder 124. In other examples, the first barrier layer 321 and the second barrier layer 322 are joined to form the seam 323 and the web area by thermal bonding. In some examples, one or both of the barrier layers 321 and 322 are heated to a temperature that facilitates shaping and melding. In some examples, the layers 321 and 322 are heated prior to being located between their respective molds. In other examples, the mold may be heated to raise the temperature of the layers 321 and 322. In some examples, a molding process used to form the bladder 124 incorporates vacuum ports within mold portions to remove air such that the first and second layers 321 and 322 are drawn into contact with respective mold portions. In other examples, fluids such as air may be injected into areas between the upper and lower layers 321 and 322 such that pressure increases cause the layers 321 and 322 to engage with surfaces of their respective mold portions. It is contemplated that the bladder 124 may be inflated from 8 PSI to 15 PSI, although other suitable values are contemplated. In an exemplary embodiment, bladder 124 may be inflated to 10 PSI.

Bladder 124 may further include a first outer heel segment 301 and a second outer heel segment 302. First segment 301 may extend along an arc corresponding to a medial side of the article of footwear 10. Second segment 302 may extend along an arc corresponding to a lateral side of the article of footwear 10. Segments 301 and 302 may extend from the heel region 16 to a portion of the mid-foot region 14. Furthermore, in at least some embodiments, segments 301 and 302 may be approximately mirror images of one another about a central longitudinal axis A124 of bladder 124. Segments 301 and 302 are disposed on opposite sides of central longitudinal axis A124, and are each concave when viewed from central longitudinal axis A124.

Referring to FIG. 3A, web area section 307 may interconnect segments 301 and 302 in the heel region. The width of segment 301 may be largest approximately at the same longitudinal position of fluid channel 314, and may gradually decrease moving toward the mid-foot. Similarly, the width of segment 302 may be largest approximately at the same longitudinal position of fluid channel 314, and may gradually decrease moving toward the mid-foot.

Referring to FIG. 3B, the bladder 124 extends from the apex at the first end 318, at the heel region, toward a second end 319 in the mid-foot. The bladder 124 slopes downward from first end 318 toward second end 319, in the direction of the ground. In other words, segments 301 and 302 may descend from the first end 318 toward the second end 319.

In an alternative embodiment, shown in FIG. 3C, instead of distinct segments 301 and 302 (which have a gap disposed between them at first end 318), bladder 124 may include a continuous U-shaped segment 324 disposed in the heel region. Segment 324 may have a substantially constant or uniform width, or may include sections of varying width as discussed herein. Segment 324 may be disposed at the first end 318.

Referring to FIG. 3A, also disposed in a portion of the heel region, bladder 124 may include an internal and hollow support (or central support) 303. Support 303 may be fluidly connected to segments 301 and 302 by fluid channels 314. The fluid channels 314 may extend from the support 303 through the web area to respective segments 301 and/or 302. Additionally, web area section 307 may be disconnected from web area (not directly in contact with) sections 306 and 308 by the one or more fluid channels 314. Moving from the heel region toward the mid-foot region, support 303 first extends radially outward, then tapers radially inward from its widest area (approximately at fluid channels 314) toward its narrowest area (in a laterally exposed central region of bladder 124), and from its narrowest portion, support 303 will taper radially outward until support 303 contacts a base 304 of a forefoot portion 305. Support 303 extends in the anterior direction relative to the anterior-most portions of segments 301 and 302.

In an alternative embodiment, not shown, the heel region may include only one fluid channel 314 that connects support 303 to the single continuous segment 324. In another embodiment, there may be more than two fluid filled channels 314.

Forefoot portion 305 may include at least two prong-like channels (or prongs) 305A and 305B. Each channel 305A and 305B may extend from support 303 and base 304, in a direction away from the heel (i.e., toward the forefoot). Channel 305A may be disposed on the medial side of a respective bladder, while channel 305B may disposed on the lateral side of the respective bladder 124. Channel 305B may be slightly longer than channel 305A to account for the geometry of the forefoot. Forefoot portion 305 may be fluidly connected to the support 303. Channels 305A and 305B each may extend radially outward moving away from support 303 in the anterior direction. In other words, first channel 305A may extend along an angled path along the medial side of the article of footwear 10. Second channel 305B may extend along an angled path along the lateral side of the article of footwear 10. Channels 305A and 305B each may also include relatively straight portions that extend substantially parallel to central longitudinal axis A124. The straight portions of channels 305A and 305B are those portions of the respective channels closest to the anterior end of the bladder 124. The straight portion of channel 305B may extend further towards the anterior end of the bladder 124 than that of the straight portion of the channel 305A. Channels 305A and 305B may extend generally in opposite directions from one another from where they converge at the anterior end of support 303. In some embodiments, channels 305A and 305B may generally be mirror images of one another, when channels 305A and 305B have the same dimensions. Channels 305A and 305B may be further fluidly connected at multiple points via cross channel lines 315, 316, and 317. in some embodiments, these lines are substantially parallel to one another, and substantially perpendicular to the central longitudinal axis of the bladder 124. However, in other embodiments, it is contemplated that lines 315, 316, and/or 317 may be offset or non-parallel to one another. Additionally, cross channel lines 315-317 may be interconnected by one or more web area sections 309-311. In particular, web area section 309 may be disposed between cross channel line 315 and base 304. Web area section 310 may be disposed between cross channel line 315 and cross channel line 316. Web area section 311 may be disposed between cross channel line 316 and cross channel line 317. Web area section 312 may be disposed on a top side of cross channel line 317. In other words, web area section 312 may be disposed on an opposite side of cross channel line 305E from web area section 311.

Segments 301 and 302, the central support 303, fluid channels 314, the prong channels 305A and 305B, and the cross channel lines 315-317 may form an interconnected and enclosed volume, which contains an inflation fluid. However, it is also contemplated that one or more or all of the aforementioned portions of bladder 124 may be fluidly isolated from the other portions.

In an exemplary embodiment, the bladder 124 may further include an inflation zone 313 disposed on the web area section 312. Inflation zone 313 may represent the anterior-most end of the bladder 124 in the forefoot region 12. Inflation zone 313 may be configured to receive a pressurized fluid (i.e., gas, liquid) to provide cushioning and stability for the foot during use of the footwear 10. In some implementations, compressibility of a first portion of the bladder 124 under an applied load may provide a responsive-type cushioning, while a second portion of the bladder 124 may be configured to provide a soft-type cushioning under an applied load. Accordingly, the bladder 124 may provide gradient cushioning to the article of footwear 10 that changes as the applied load changes (i.e., the greater the load, the more the bladder 124 is compressed and, thus, the more responsive the footwear 10 performs).

Referring to FIGS. 1-3C, the bladder 124 may be continuously exposed along an outer periphery of lateral and medial sides of the article of footwear 10 from the heel region 16 to a portion of the forefoot region 12 corresponding to the ball portion 12B. In other words, substantial entireties of the lateral and medial portions bladder 124 may be exposed and visible from an exterior of footwear 10 when footwear 10 is fully assembled. In one embodiment, an exterior portion of bladder 124 (facing in the posterior direction) may be covered by mold 130. However, in other embodiments, the outer surfaces of bladder 124 may be exposed (and not covered by mold 130).

In an alternative embodiment, bladder 124 may include a polymer foam and/or particulate matter in one or more, or all, regions of the bladder 124 corresponding to the enclosed inner volume of the bladder 124. Specifically, the polymer foam and/or particulate matter may be present in segments 301 and 302, central support 303, base 304, forefoot portion 305, channels 305A and 305B, fluid channels 314, and/or channel connection lines 314-317 in place of, or in addition to, the pressurized fluid to provide cushioning for the foot. In these implementations, the cushioning materials may provide one or more of the segments 301 and 302, central support 303, base 304, forefoot portion 305, channels 305A and 305B, fluid channels 314, and/or channel connection lines 314-317 with cushioning properties different from the segments 301 and 302, central support 303, base 304, forefoot portion 305, channels 305A and 305B, fluid channels 314, and/or channel connection lines 314-317 filled with the pressurized fluid. For example, the cushioning materials may be more or less responsive or provide greater impact absorption than the pressurized fluid.

Heel Cushioning Element and Forefoot Cushioning Element

Figure 4:
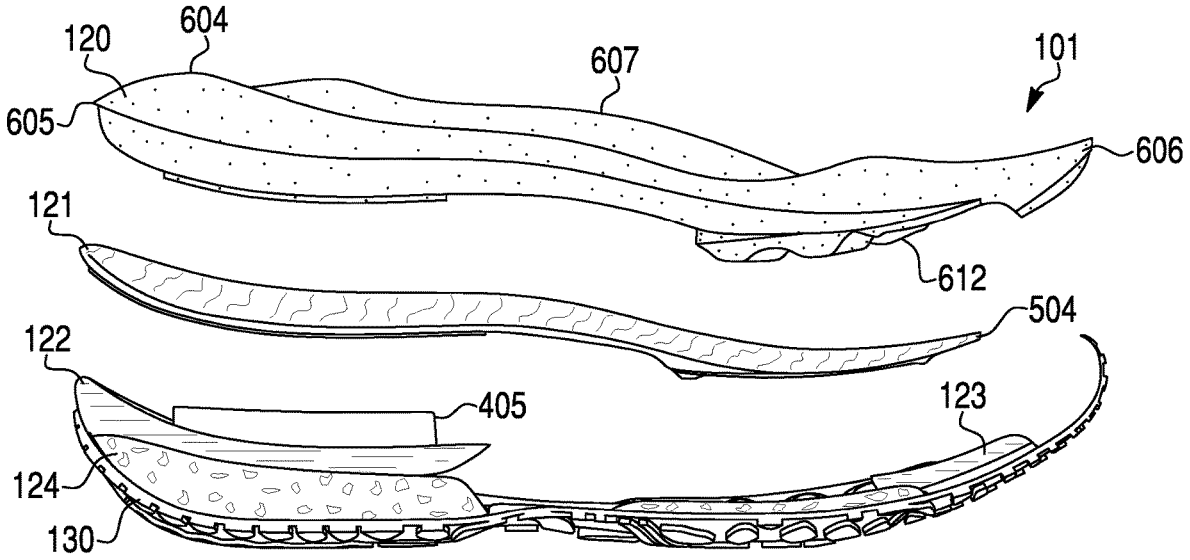
FIG. 4 illustrates a partially exploded view of the sole structure of the article of footwear of FIG. 1.
Figure 4A:
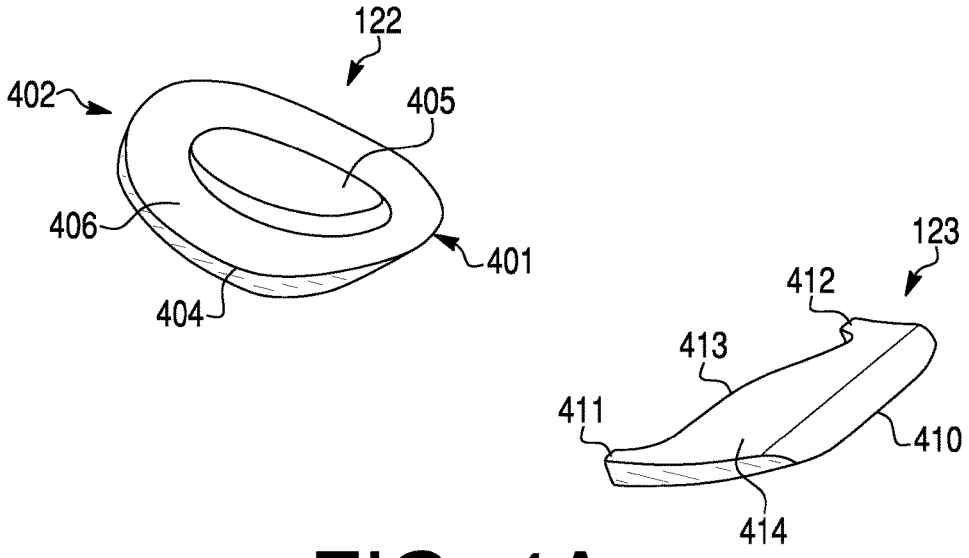
FIG. 4*a* illustrates a perspective view of various cushioning elements of the sole structure of the article of footwear of FIG. 1.

Referring to FIGS. 4-4A, the heel cushioning element 122 and forefoot cushioning element 123 may provide, for example, cushioning and support. Heel cushioning element 122 may be configured to cooperate/abut with the first barrier layer 321 of the bladder 124 on its bottom side and the plate 121 on its top side. Heel cushioning element 122 may include one or segments 403 (shown in FIG. 3) on a bottom surface thereof. Heel cushioning element 122 may have a substantially ovular shape, although other suitable shapes are contemplated, e.g., circular, rounded rectangular, irregular and the like. Heel cushioning element 122 may extend continuously from a first end 401 (positioned closest to the user's heel) to a second end 402 (positioned closer to in the mid-foot region 14 than first end 401). First end 401 may slope downwards towards a relatively flat region 404 of the heel cushioning element 122 and the heel cushioning element 122 may be substantially straight from the region 404 towards the second end 402. Heel cushioning element 122 may include a compressible material.

Heel cushioning element 122 may have disposed on its top side a plateau 405, extending upward and away from a top surface 406. The bottom of plateau 405 may be completely surrounded by top surface 406 of the heel cushioning element 122. Top surface 406, thus, may form a flange configured to engage with the bottom surface of plate 121 when footwear 10 is fully-assembled. The height at which plateau 405 extends from top surface 406 may vary. Generally, plateau 405 may extend further (higher) from top surface 406 at its anterior-most regions, and may extend less (lower) from top surface 406 at its posterior-most regions.

Figure 2B:
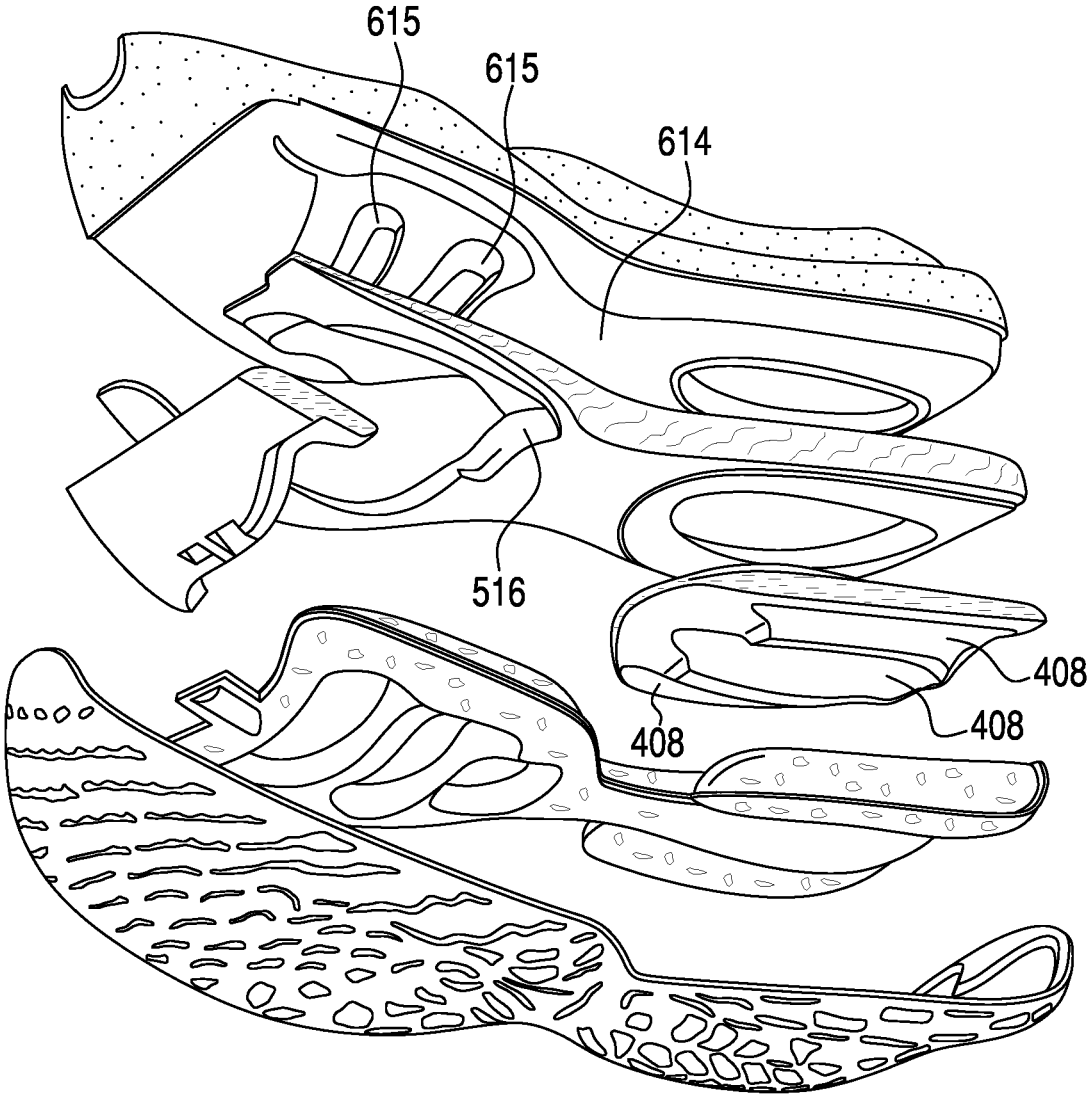
FIG. 2*b* illustrates an exploded bottom perspective view of the sole structure of the article of footwear of FIG. 1.

Heel cushioning element 122 may have disposed on its bottom side one or more recesses 408A, 408B, and 408C (shown in FIG. 2B). Recesses 408 may be substantially hollow and tubular. Recess 408A may be configured to receive heel segment 301. Recess 408B may be configured to receive a portion of central support 303. Recess 408C may be configured to receive heel segment 302. In other words, recesses 408 may engage first barrier layer 321 of the bladder 124 at the heel segments and the central support.

Figure 11A:
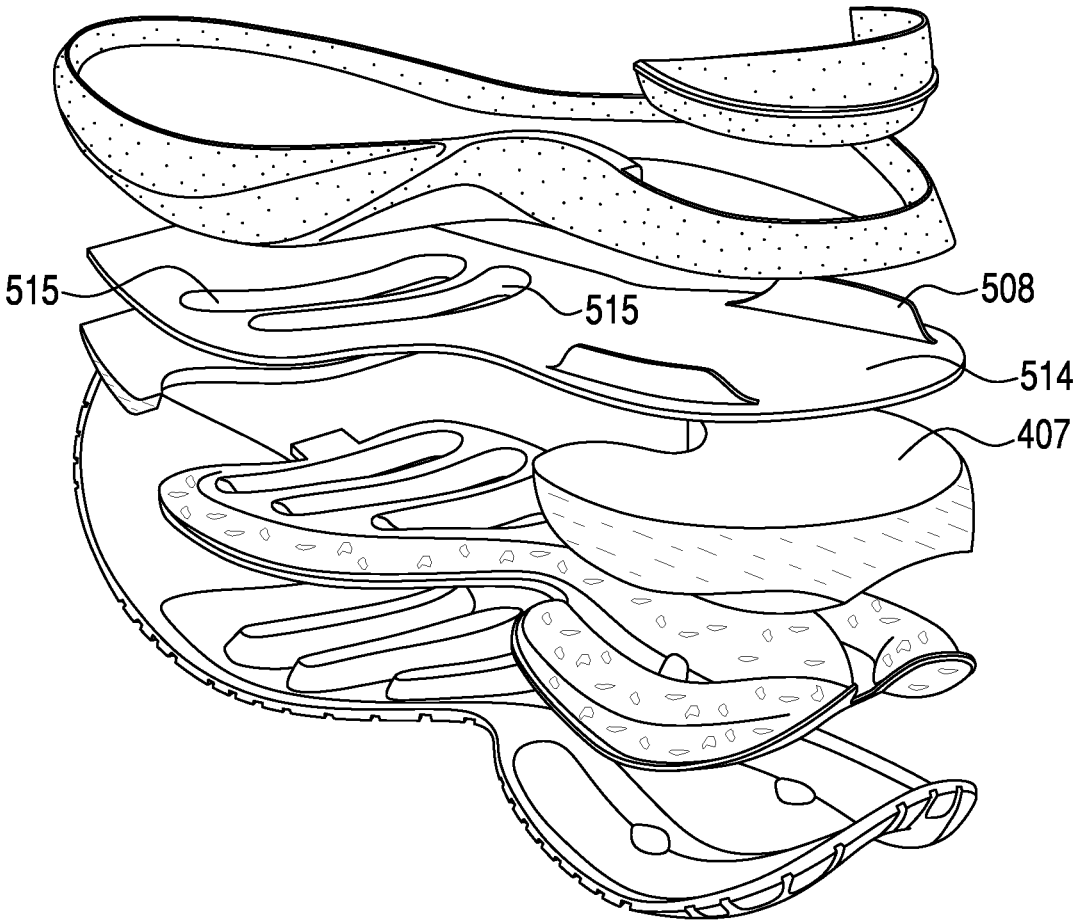
FIG. 11*a* illustrates an exploded view of an alternative embodiment of the sole structure of the article of footwear of FIG. 1.

In an alternative embodiment, shown in FIG. 11A, heel cushioning element 122 may have a surface 407 in place of plateau 405. Surface 407 may be an indent within the heel cushioning element 122. It is contemplated that surface 407 may also be a substantially flat surface.

With continued reference to FIGS. 4-4*a*, forefoot cushioning element 123 may be disposed in the forefoot region 12 to provide cushioning and support. Forefoot cushioning element 123 may have a top surface 414 and a bottom surface 415 that are generally parallel to one another, although other suitable configurations also are contemplated. Forefoot cushioning element 123 may also include a first, anterior-most end 410 (which is disposed in the toe portion 12T when footwear 10 is fully assembled), a second, posterior-most end 413 (disposed in the ball portion 12B when footwear 10 is fully assembled). Forefoot cushioning element 123 also includes at least two nubs 411 and 412 disposed in the ball region and extending in the posterior direction away from second end 413. Nubs 411 and 412 may be disposed at the lateral ends of forefoot cushioning element 123. Nub 411 may be disposed at the lateral end of forefoot cushioning element 123 corresponding to the medial side 22. Nub 412 may be disposed at the lateral end of forefoot cushioning element 123 corresponding to the lateral side 23. Top surface 414 and bottom surface 415 may converge at their anterior ends, forming one or more inclined surfaces resembling a wedge, ramp, or cliff at the anterior end. Forefoot cushioning element may include the same or similar materials as heel cushioning element 122, and materials for each are discussed in further detail below in the Materials section of the specification.

Ground Contacting Portion/Mold

Referring to FIGS. 2 and 10, the mold 130 includes an opposing pair of surfaces defining a thickness of the mold. The surfaces include a concave inner surface and a concave outer surface, when the footwear 10 is viewed from above. The outer surface may define a portion (or an entirety) of the ground-contacting surface of the sole structure 101. The mold 130 may be the bottommost portion of the sole structure 101 and of footwear 10. The mold 130 may extend from a first, posterior-most end 704, radially outward, and then taper radially inward towards its narrowest portion 706 in the mid-foot region. The mold 130 may then extend from narrowest portion 706 radially outward in the ball portion 12B to a widest portion 707 of mold 130, and gradually taper inward toward the second, anterior-most end 705.

The mold 130 may be continuously exposed along the outer periphery of the sole structure from the heel region 16 to the forefoot region 12.

Referring to FIG. 10, mold 130 may include a plurality of traction elements 703. The plurality of traction elements 703 may be present on a substantial portion of the ground-engaging surface of mold 130. The plurality of traction elements 703 may also be present on the entirety of the ground-engaging surface of mold 130. The plurality of traction elements 703 may have a substantially rectangular, triangular, linear, or ovoidal shape. It is also contemplated that the plurality of traction elements 703 may be of a shape suitable for providing traction.

Plate

Figure 5:
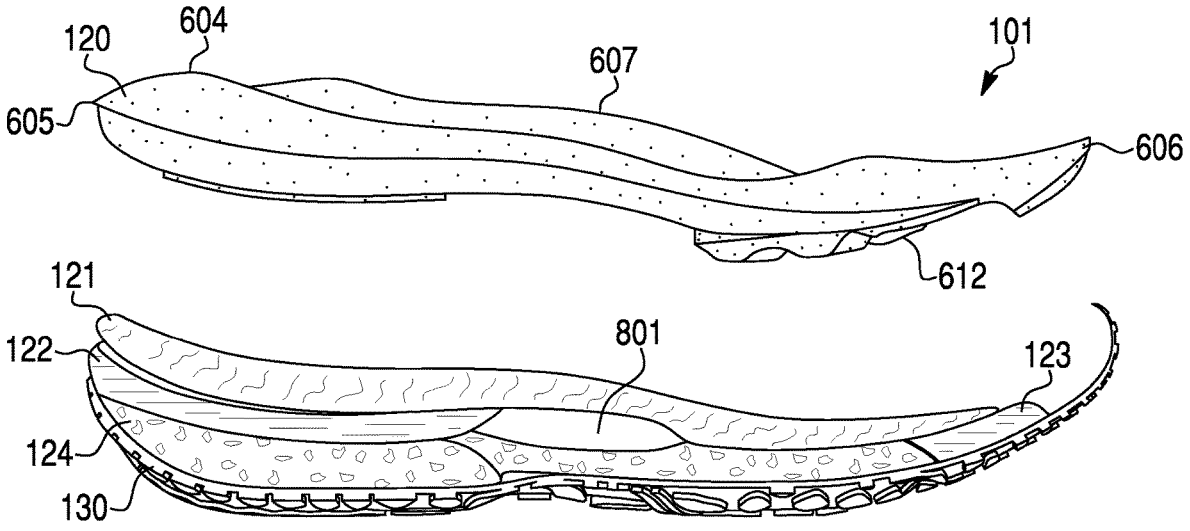
FIG. 5 illustrates a partially exploded view of the sole structure of the article of footwear of FIG. 1.
Figure 5A:
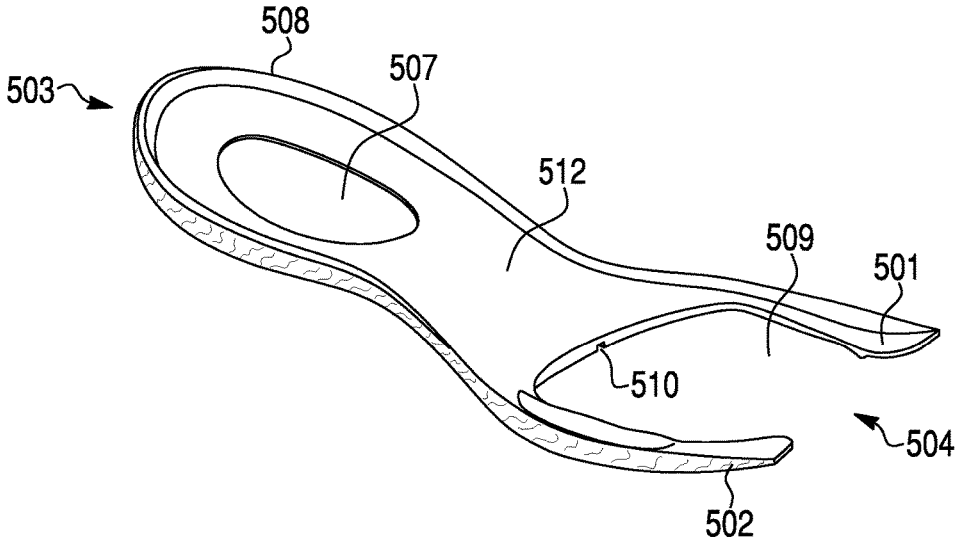
FIG. 5*a* illustrates a top-down view of a plate of the sole structure of the article of footwear of FIG. 1.
Figure 5B:
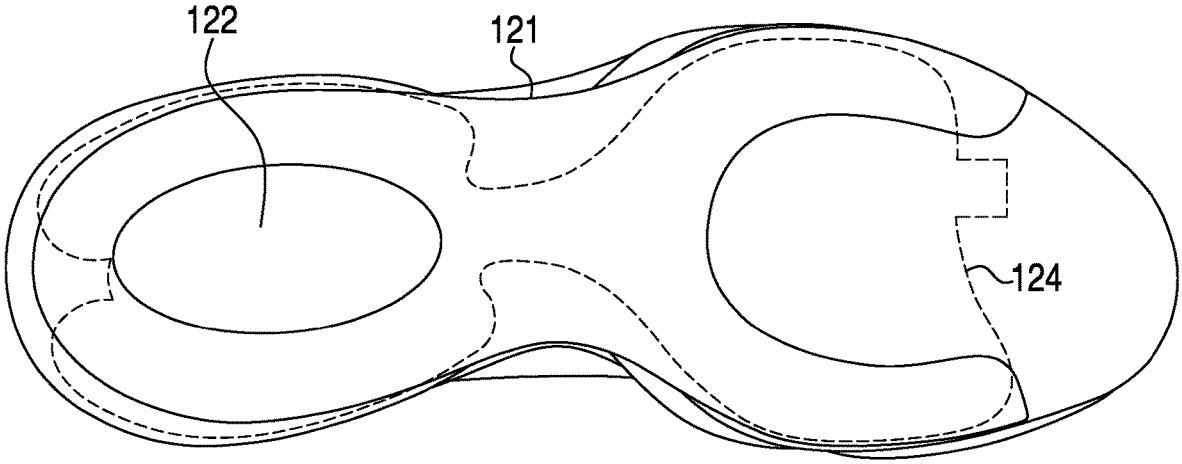
FIG. 5*b* illustrates a section view of the sole structure of the article of footwear of FIG. 1.

Referring to FIGS. 5-5B, the plate 121 may include a soft and flexible material that may provide cushioning and support. Plate 121 may include a material that is substantially pliable. Plate 121 may extend from a posterior end 503 present in the heel region 16 to an anterior end 504 present in a portion of the forefoot region 12. Plate 121 may include an opening 507 extending through a heel region of the plate 121 at posterior end 503. The opening 507 may be dimensioned and configured to receive plateau 405. Opening 507 may be substantially ovular in shape, although other suitable shapes also are contemplated. Opening 507 may leave an area devoid of material within the plate 121.

Plate 121 also may include at least two limbs 501 and 502 that protrude from an anterior surface 510 of plate 121 in the anterior direction. Limbs 501, 502, and anterior surface 510 may generally define a U-shaped or horseshoe-shaped boundary around a recess 509. Limbs 501 and 502 may extend from the mid-foot region 14 along the path defining the outer bounds of plate 121. Referring to FIG. 2B, on a bottom surface of limbs 501 and 502 and anterior surface 510 may be disposed a recessed area 516 that is recessed relative to the bottom surface of plate 121. Area 516 may generally have a "U" shape. Area 516 may be present on the bottom surface of limbs 510 and 502 and interior surface 510. Area 516 may terminate at a position posterior to the anterior ends of limbs 501 and 502. In other words, area 516 may span continuously across both limbs 501 and 502 in the forefoot of plate 121, but may not reach the full length of limbs 501 and 502.

Plate 121 may further include a top surface 512, a bottom surface 513, and a sidewall 508. The plate 121 may have a thickness in the heel and mid-foot regions that is greater than a thickness in the forefoot region.

When article of footwear 10 is fully assembled, the recess 509 may extend from the mid-foot region of footwear 10 toward the forefoot region, and may terminate or end at the toe portion 12T.

The sidewall 508 may surround a substantial entirety of the plate 121. The sidewall 508 may extend vertically upward from the top surface 512 of the plate 121. Posterior end 503 may have a substantially bulbous shape corresponding to the sidewall 508. The outer bounds of plate 121 may be defined by a path of the sidewall 508. The path may further be defined by the bulbous posterior end and taper radially outward around the opening 507 and taper radially inward moving in the anterior direction from the opening 507. The path may gradually taper radially outward towards the limbs 501 and 502 and flatten out as it approaches the posterior end 503 of the plate 121 (e.g., the posterior-most portions of limbs 501 and 502 may be substantially flat).

Figure 11B:
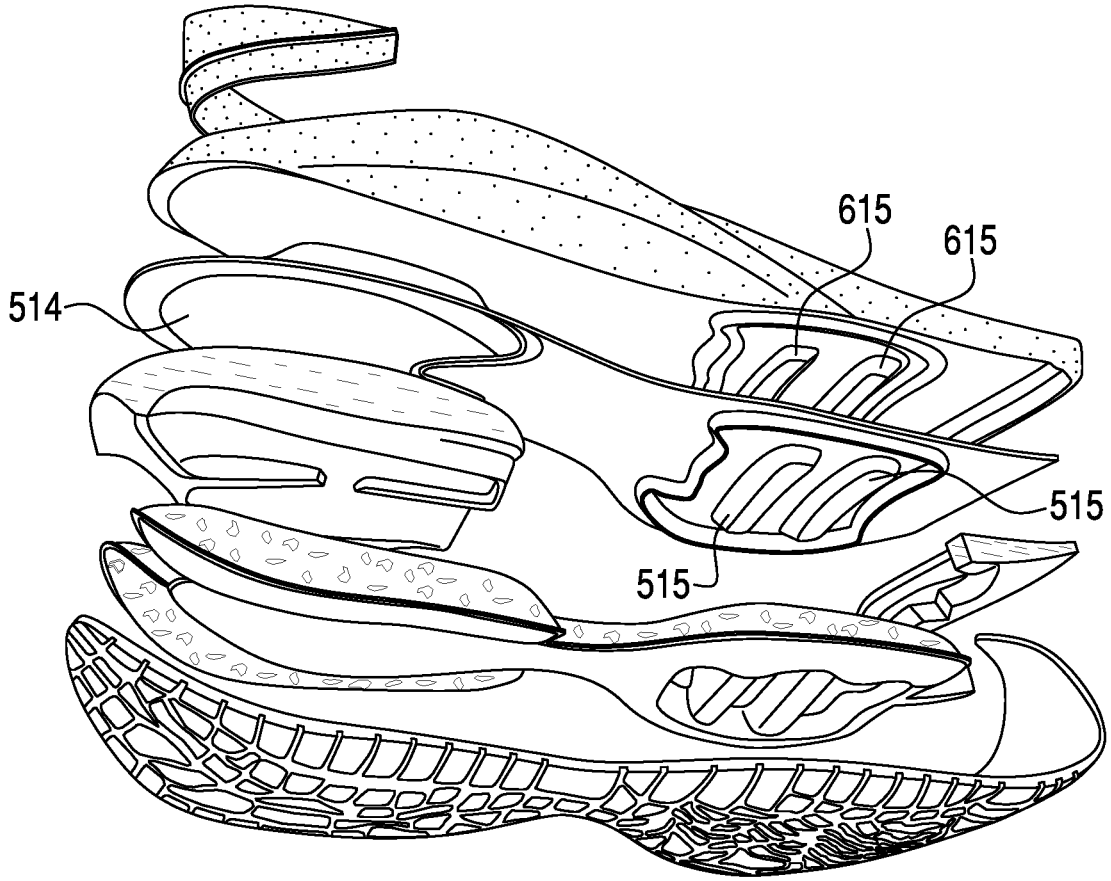
FIG. 11*b* illustrates an exploded bottom perspective view of an alternative embodiment of the sole structure of the article of footwear of FIG. 1.

In an alternative embodiment, shown in FIGS. 11A and 11B, plate 121 may not include either of opening 507 or 509. In other words, plate 121 may be substantially continuous and not have any areas devoid of material. Additionally, sidewall 508 may be disposed only in the heel. Further, sidewall 508 may be present on only the medial and lateral sides of the heel of plate 121. Plate 121 may have disposed in the forefoot region one or more indents 515. Indents 515 may span a width of the plate 121 in the forefoot. Plate 121 may also have disposed on its top surface 512 a surface 514. Surface 514 may be substantially flat. It is contemplated that surface 514 may be indented within plate 121. Surface 514 may cooperate with upper cushioning element 120 in the heel and may have a corresponding bottom side (shown in FIG. 11B) that cooperates with bladder 124.

Upper Cushioning Element

Figure 6:
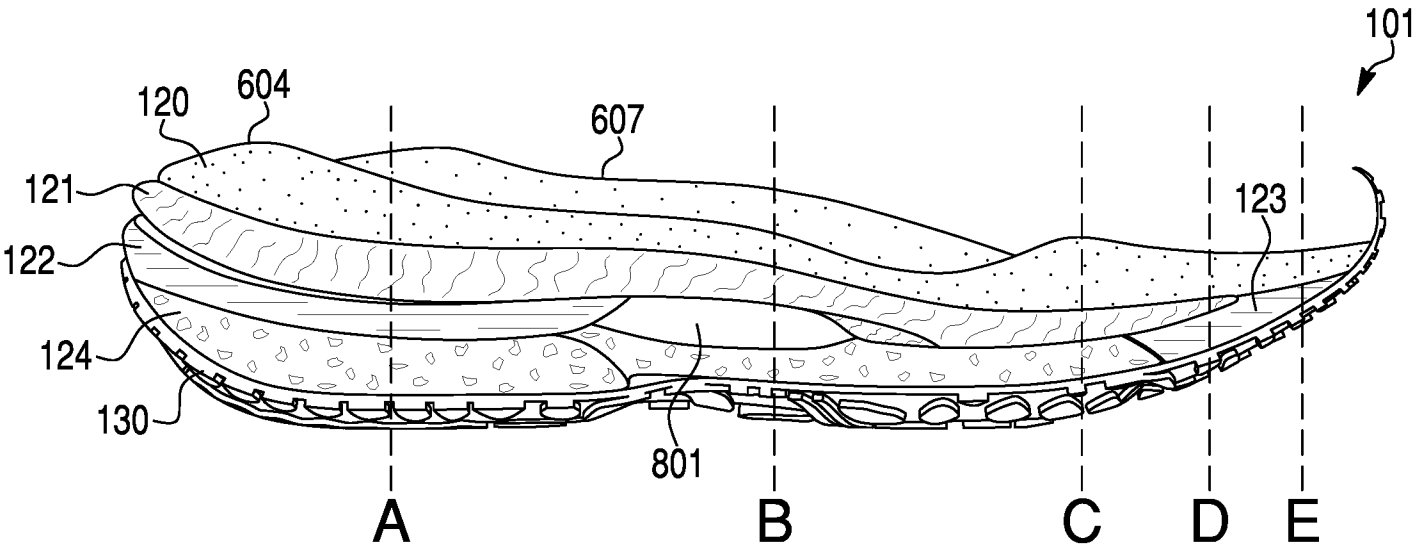
FIG. 6 illustrates a side view of a fully-assembled sole structure of the article of footwear of FIG. 1.
Figure 6A:
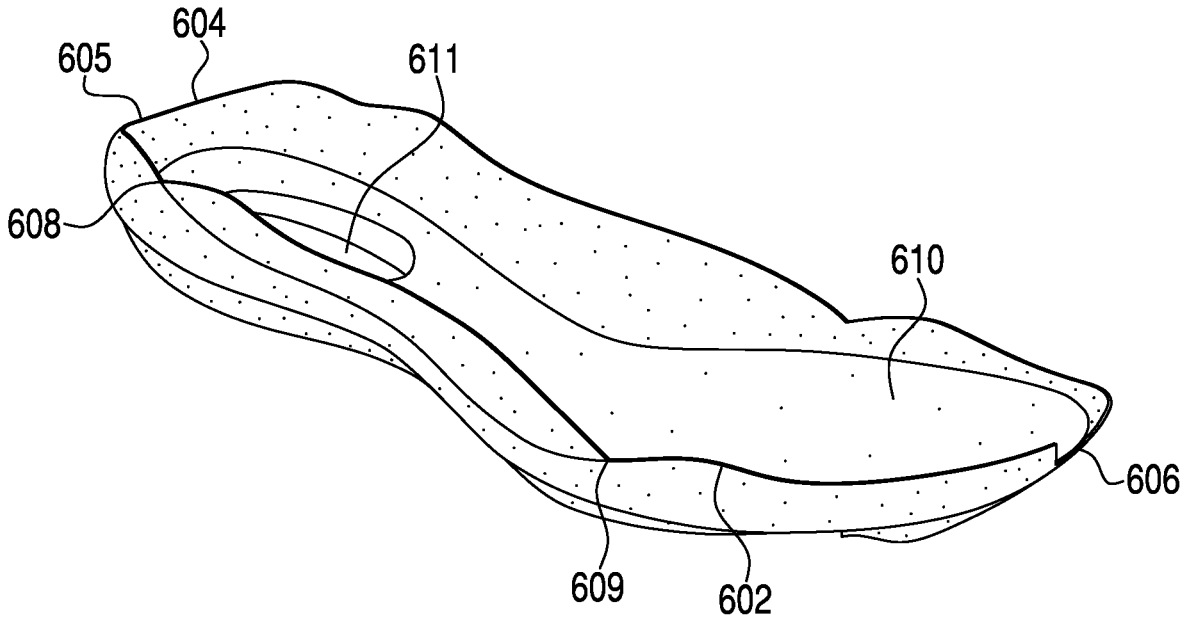
FIG. 6*a* illustrates a perspective view of an upper cushioning element of the sole structure of the article of footwear.

Referring to FIGS. 6 and 6A, the upper cushioning element 120 may include a material that may provide cushioning and support. Upper cushioning element 120 may include a material that is substantially rigid. For example, upper cushioning element 120 may be comprised of a firm foam. Upper cushioning element 120 may extend from the posterior end 20 to the anterior end 18.

Upper cushioning element 120 may include an upper sidewall 604, an interior top surface (or interior surface) 610, a cavity 611, and a bottom surface 614. The medial side 22 and the lateral side 24 of the article of footwear 10 may laterally bound upper sidewall 604. The sidewall 604 may extend vertically upward from the interior surface 610. The top surface of sidewall 604 may be defined by an undulating path that slopes between a plurality of peaks and valleys from a posterior base 605 located in the heel region 16 to an anterior base 606 located in the forefoot region 12. The undulating path may have a more gradual slope from one of the peaks 602 to the anterior base 606. The sidewall 604 may be disconnected at the anterior base 606 and may have an area devoid of sidewall 604 at the anterior base 606 in order to accommodate the anterior portion of mold 130 when footwear 10 is assembled (see, e.g., FIG. 6).

Located between the posterior base 605 and the anterior base 606 may be an extension 607. Extension 607 may contact a first contact point 608 near the posterior base 606 and may contact a second contact point 609 near the anterior base 606. Extension 607 may be of the same material as upper cushioning element 120. In another embodiment, extension 607 may be a different material than that of cushioning element 120.

Upper sidewall 604 may bound the interior surface 610 of the upper cushioning element 120. Interior surface 610 may contain the cavity 611 that may be substantially ovular in shape. The shape of cavity 611 may correspond with the shape of opening 507, as cavity 611 also may be configured and dimensioned to receive a portion of plateau 405 when footwear 10 is assembled.

Referring to FIG. 2B, bottom surface 614 may include one or more protrusions 615. Protrusions 615 may extend through the recess 509 of plate 121. One of the one or more protrusions 615 may be received by web area 310. A second one of the one or more protrusions 615 may be received by web area 311. In other words, protrusions 615 may cooperate with the forefoot web areas of the bladder 124 by extending through the recess 509 of plate 121.

In an alternative embodiment, shown in FIGS. 11A and 11B, upper cushioning element 120 may be substantially continuous and not include an area devoid of material. In other words, upper cushioning element 120 may not include cavity 611. Protrusions 615 of upper cushioning element 120 may cooperate with the plate 121 of the alternative embodiment shown in FIGS. 11A and 11B.

Heel Counter

Referring to FIG. 1, the sole structure 101 may further include a heel counter 125 extending upward from the upper cushioning element 120. The heel counter 125 may extend around the posterior end 20. The heel counter 125 may extend from a first contact portion (not shown) on the medial side 22 to an apex 803. Similarly, the heel counter 125 may extend from a second contact portion 802 on the lateral side 24 to the apex 803. The heel counter 125 may swell from a first height located at the contact portions to a second height that is different from the first height, located at the apex 803. The medial side 22 and the lateral side 24 of the heel counter 125 may be mirror images of each other. The heel counter 125 may be formed of the same material as the upper cushioning element 120. The heel counter 125 may be formed of a different material to that of the upper cushioning element 120.

Assembled Article of Footwear

In other words, the bladder 124 may serve as the base of the stacked sole structure. The heel cushioning element 122 may be directly disposed on the top surface of bladder 124. The forefoot cushioning element 123 may be directly coupled to an anterior facing surface of the bladder 124. The plate 121 may be directly disposed on the top surface of bladder 124 in the forefoot region and may be disposed directly on the surface of heel cushioning element 122 in the heel region. Upper cushioning element 120 may be directly disposed on the top surface of the plate 121 in the forefoot and may be directly disposed on the top surface of heel cushioning element 122 in the heel, in some alternative embodiments. This ordered combination forms the stacked sole structure. However, it should be noted that other combinations also are contemplated. For example, in one embodiment, one or more of the aforementioned structures may be omitted from the stack. For example, forefoot cushioning element 123 may be omitted. In such an embodiment, the bladder and/or the plate may be extended in the anterior direction from what is shown in FIG. 1.

Referring to FIG. 6, when viewing the exterior of the footwear 10 from the ground up, the sole structure includes mold 130, bladder 124, heel cushioning element 122, forefoot cushioning element 123, plate 121, and upper cushioning element 120.

Referring to FIG. 6, when viewing the stacked sole structure from the ground up along the exterior path of line A, the stacked sole structure may include the mold 130, the bladder 124, the heel cushioning element 122, the plate 121, and the upper cushioning element 120. When viewed along the exterior path of line B, the stacked sole structure may include the mold 130, the bladder 124, an exposed opening/gap 801, the plate 121, and the upper cushioning element 120. When viewed along the exterior path of line C, the stacked sole structure may include the mold 130, the bladder 124, the plate 121, and the upper cushioning element 120. When viewed along the exterior path of line D, the stacked sole structure may include the mold 130, the forefoot cushioning element 123, the plate 121, and the upper cushioning element 120. When viewed along the exterior path of line E, the stacked sole structure may include the mold 130, the forefoot cushioning element 123, and the upper cushioning element 120.

Further, when viewing the sole structure along the exterior path of line B, the stacked sole structure may form an opening 801 in the mid-foot region. The opening 801 may be an area devoid of material formed between the plate 121 and the bladder 124. The opening 801 may leave exposed the upper barrier layer of bladder 124 and an exposed bottom surface 513 of plate 121. In other words, the assembled stacked sole may form a gap in the mid-foot between the plate 121 and the bladder 124 such that a viewer would see through this mid-foot portion of the stacked sole structure with an unobstructed view. In other words, when viewed from a vantage point that is exterior of the sole structure, the upper barrier layer of bladder 124 and the bottom surface 513 of plate 121 are open to the environment. The opening 801 may be substantially ovular in shape although other suitable shapes are contemplated, e.g., circular, rounded rectangular, irregular and the like. The opening 801 and the exposed surfaces of bladder 124 and exposed bottom surface 513 are exposed to or otherwise in fluid communication with the external environment/atmosphere exterior of the article of footwear 10.

While FIGS. 1-10 depict a sole structure 101 for a right foot of a user of the article of footwear, it is contemplated that the above description may apply to a left foot of a user of the article of footwear.

Cross-Section

Figure 7:
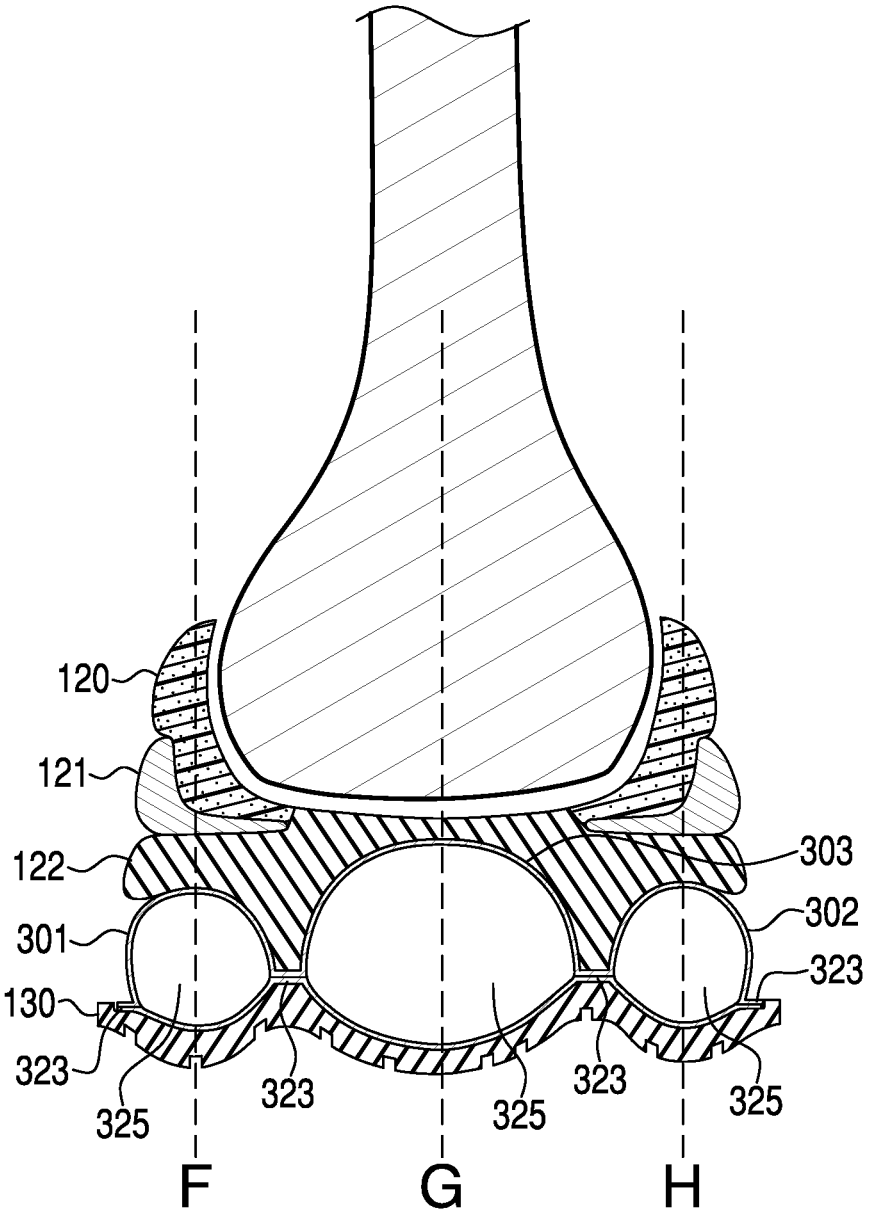
FIG. 7 illustrates a cross-sectional view taken along line 7-7 of the sole structure of the article of footwear of FIG. 1.
Figure 8:
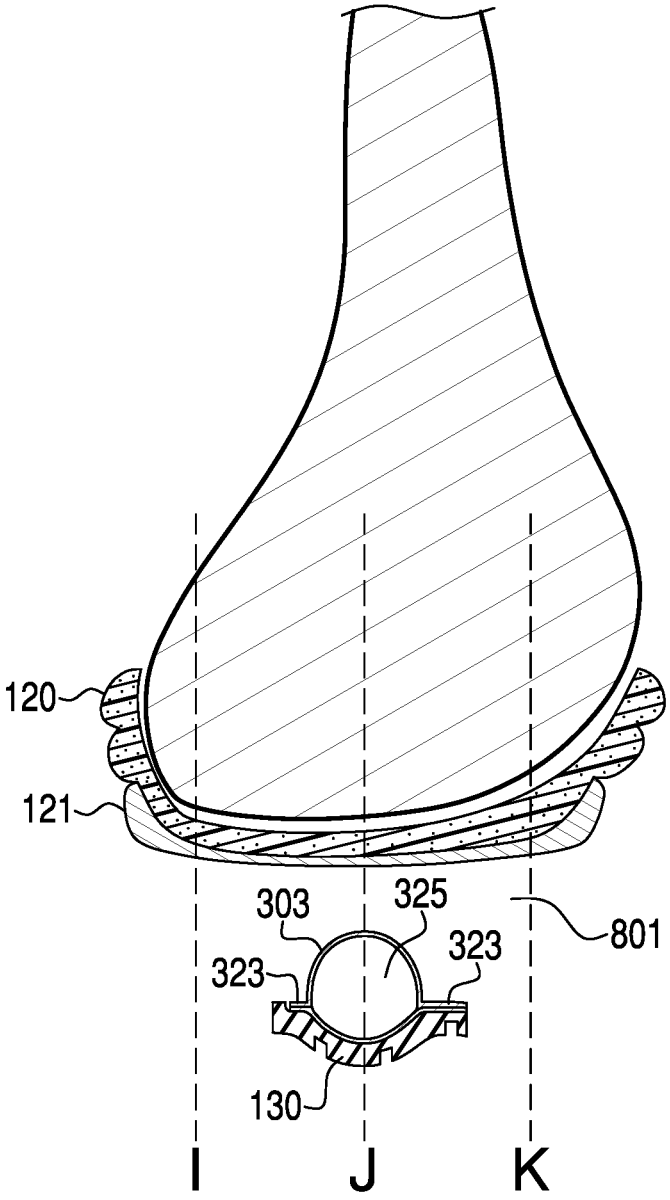
FIG. 8 illustrates a cross-sectional view taken along line 8-8 of the sole structure of the article of footwear of FIG. 1.
Figure 9:
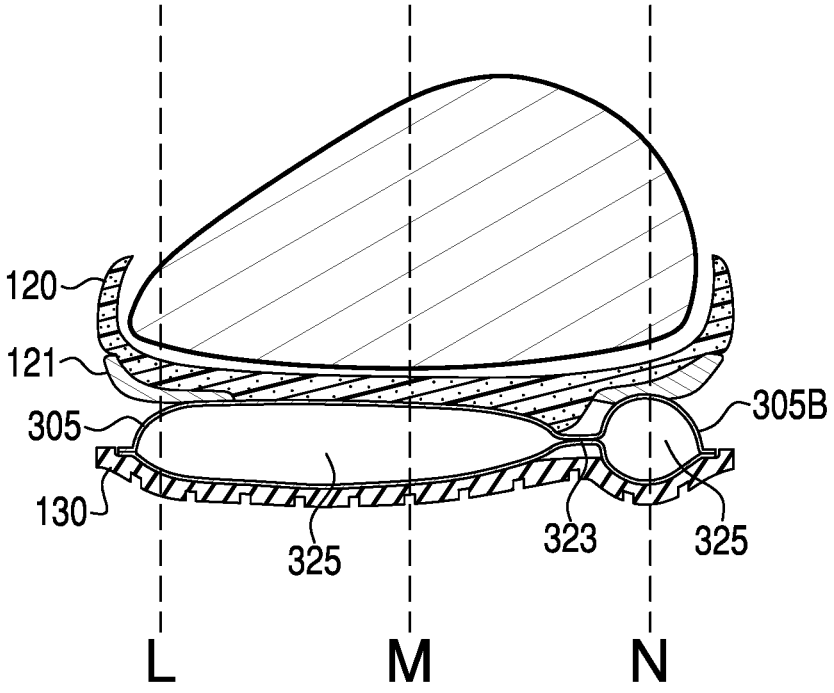
FIG. 9 illustrates a cross-sectional view taken along line 9-9 of the sole structure of the article of footwear of FIG. 1.

Referring to FIGS. 7-9, the stacked sole structure may have a varied composition when viewing down the cross-sections 7-7, 8-8, and 9-9 (shown in FIG. 1).

Referring to FIG. 7, cross-section 7-7 depicts the stacked sole structure including the bladder 124, the heel cushioning element 122, the plate 121, and the upper cushioning element 120. The view of the stacked sole structure along cross-section 7-7 may further follow interior paths F, G, and H. When viewed from the ground up, interior path F may encounter the mold 130, the first outer heel segment 301, the heel cushioning element 122, the plate 121, and the upper cushioning element 120. When viewed from the ground up, interior path G may encounter only the mold 130, the support 303, and the heel cushioning element 122. When viewed from the ground up, interior path H may encounter the mold 130, the second outer heel segment 302, the heel cushioning element 122, the plate 121, and the upper cushioning element 120.

Referring to FIG. 8, cross-section 8-8 depicts the stacked sole structure including the bladder 124, the plate 121, and the upper cushioning element 120. The view of the stacked sole structure along cross-section 8-8 may further follow interior paths I, J, and K. When viewed from the ground up, interior path I may encounter only the opening 801, the plate 121, and the upper cushioning element 120. When viewed from the ground up, interior path J may encounter the mold 130, the support 303, the opening 801, the plate 121, and the upper cushioning element 120. When viewed from the ground up, interior path K may encounter only the opening 801, the plate 121, and the upper cushioning element 120.

Referring to FIG. 9, cross-section 9-9 depicts the stacked sole structure including the bladder 124, the plate 121, and the upper cushioning element 120. The view of the stacked sole structure along cross-section 9-9 may further follow interior paths L, M, and N. When viewed from the ground up, interior path L may encounter the forefoot portion 305, the plate 121, and the upper cushioning element 120. When viewed from the ground up, interior path M may encounter the mold 130, the forefoot portion 305, the opening 507, and the upper cushioning element 120. When viewed from the ground up, interior path N may encounter the mold 130, the channel 305B, the plate 121, and the upper cushioning element 120.

Materials

One or both of the barrier layers 321 and 322 may independently be transparent, translucent, and/or opaque. As used herein, the term "transparent" for a barrier layer and/or a bladder means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers of bladder 124 may each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone[1]based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The plate 121 may be formed of one or more pliable materials having a durometer that may be less than the durometer of the upper cushioning element 120 and/or equal to the durometer of the cushioning elements 122 and 123. For example, upper cushioning element 120 may be formed of CMP-004 (54-54 Asker C), plate 121 may be formed of Estane 385A, heel cushioning element 122 may be formed of Cushion LU/FO 035 (52-56 Asker C), and forefoot cushioning element 123 may be formed of IP 004 (57-61 Asker C), although other suitable materials also are contemplated.

One or more of the cushioning elements 120, 122, and 123 may be formed of a resilient polymeric material, such as foam or rubber, to impart properties of cushioning, responsiveness, and energy distribution to the foot of the wearer. In the illustrated example, the upper cushioning element 120 may be formed of a first foam material, the heel cushioning element 122 may be formed of a second foam material, and the forefoot cushioning element 123 may formed of a third foam material. The heel cushioning element 122 and the forefoot cushioning element 123 may be formed of the same foam material. For example, the upper cushioning element 120 may be formed of a first foamed material having a first durometer, the heel cushioning element 122 may be formed of a second foamed material having a second durometer that may be less than the first durometer. The forefoot cushioning element 123 may be formed of a third material having a third durometer that may be less than the first durometer and the second durometer. The heel cushioning element 122 and the forefoot cushioning element 123 may include a foamed material that may have the same durometer. The cushioning elements 120, 122, and 123 may be affixed within the sole structure using a fusing process, using an adhesive, or by suspending the elements in a different resilient polymeric material. As discussed above, the cushioning elements 120, 122, and 123 may be formed with cooperating geometries (e.g., steps, protrusions) for restricting relative motion between the cushioning elements 120, 122, and 123 and the sole structure.

Example resilient polymeric materials for the cushioning elements 120, 122, and 123 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Further Discussion

As set forth above, the sole structure 101 of the present disclosure may advantageously provide layered cushioning in combination with a flexible support plate while simultaneously providing a new aesthetic. Particularly, the sole structure may provide layered cushioning by including a stack structure in the heel and forefoot regions. This configuration may provide improved impact attenuation associated with a heel strike during walking. The sole structure 101 may provide heel layered cushioning by providing an upper cushioning element 120 in layered arrangement with the plate 121, heel cushioning element 122, and bladder 124 in the heel region. The sole structure 101 may provide forefoot layered cushioning by providing an upper cushioning element 120 in layered arrangement with the plate 121 and bladder 124 in the forefoot region. Thus, the sole structure 101, having heel and forefoot layered cushioning, may provide underfoot cushioning. Providing a full-length plate 121 between the upper cushioning element 120 and the bladder 124 may further increase stability within the sole structure 101. Altogether, these features may cooperate to provide a desirable configuration for articles of footwear associated with long periods of standing and walking. Additionally, the desirable configuration for articles of footwear may be associated with a woman's foot structure.

The following Clauses provide an exemplary configuration for an article of footwear and sole structure described above.

The following Clauses provide an exemplary configuration for an article of footwear and sole structure as described above.

Clause 1. A sole structure for an article of footwear, the sole structure comprising a forefoot region disposed adjacent an anterior end; a heel region disposed adjacent a posterior end; a bottom cushion extending from the heel region to the forefoot region; a heel cushion coupled to a top surface of the bottom cushion in the heel region; a support plate coupled to a) a top surface of the heel cushion in the heel region, and b) a top surface of the bottom cushion in the forefoot region; and a top cushion coupled to a top surface of the support plate.

Clause 2. The sole structure of clause 1, wherein the bottom cushion is a fluid-filled bladder.

Clause 3. The sole structure of clause 2, wherein the fluid-filled bladder includes a first segment in the heel region, the first segment containing a fluid-filled hollow interior, the first segment being concave when viewed from a central longitudinal axis of the bladder; and a second segment in the heel region disposed on an opposite side of the central longitudinal axis than the first segment, the second segment containing a fluid-filled hollow interior, the second segment being concave when viewed from the central longitudinal axis of the bladder.

Clause 4. The sole structure of clause 3, wherein the fluid-filled bladder further includes a central support disposed laterally between the first segment and the second segment in the heel region, the central support containing a fluid-filled hollow interior, wherein the central support extends to a midfoot region of sole structure, to a position anterior of anterior-most portions of the first segment and the second segment.

Clause 5. The sole structure of clause 4, wherein the fluid-filled bladder further includes a first prong extending from an anterior end of the central support, wherein the first prong has 1) a first section that extends radially outward in an anterior direction, and 2) a second section extending anterior to an anterior end of the first section, wherein the second section is substantially parallel to the central longitudinal axis.

Clause 6. The sole structure of clause 5, wherein the fluid-filled bladder further includes a second prong extending from an anterior end of the central support, wherein the first prong has 1) a first section that extends radially outward in the anterior direction, and 2) a second section extending anterior to an anterior end of the first section, wherein the second section is substantially parallel to the central longitudinal axis, wherein the first prong and the second prong extend in opposite directions relative to the central longitudinal axis.

Clause 7. The sole structure of clause 4, wherein outer surfaces of the central support are laterally-outermost portions of the bladder in the midfoot region.

Clause 8. The sole structure of clause 2, wherein the fluid-filled bladder includes an exposed upper surface when the sole structure is in a fully-assembled configuration.

Clause 9. The sole structure of clause 8, wherein the exposed upper surface is not directly connected to any other material.

Clause 10. The sole structure of clause 8, wherein the exposed upper surface is disposed in a midfoot region of the sole structure.

Clause 11. The sole structure of clause 8, wherein the exposed upper surface is visible from a vantage point that is exterior of the sole structure.

Clause 12. The sole structure of clause 8, wherein the exposed upper surface is open to the environment exterior of the article of footwear.

Clause 13. The sole structure of clause 1, wherein along a first path of an exterior of the sole structure, the heel region is arranged from a bottom to a top of the article, to include the bottom cushion; the heel cushion; the support plate; and the top cushion.

Clause 14. The sole structure of clause 13, wherein along a second path of the exterior of the sole structure, a midfoot region is arranged from the bottom to the top of the article, to include the bottom cushion, wherein the bottom cushion includes an exposed upper surface in the midfoot region when the sole structure is fully assembled; a gap that is open to the external environment, the gap being defined at a bottom end by the exposed upper surface of the bottom cushion; the support plate; and the top cushion.

Clause 15. The sole structure of clause 14, wherein along a third path of the exterior of the sole structure, the forefoot region is arranged from the bottom to the top of the article, to include a forefoot cushion; the support plate; and the top cushion.

Clause 16. The sole structure of clause 15, wherein along the second path, the heel cushion and the forefoot cushion are absent.

Clause 17. The sole structure of clause 15, wherein along the third path, the bottom cushion is absent.

Clause 18. The sole structure of clause 15, wherein along a fourth path of the exterior of the sole structure that is posterior to the third path, the forefoot region is arranged from the bottom to the top of the article, to include the bottom cushion; the support plate; and the top cushion.

Clause 19. The sole structure of clause 18, wherein along the fourth path, the heel cushion and the forefoot cushion are absent.

Clause 20. The sole structure of clause 15, wherein along a fifth path of the exterior of the sole structure that is anterior to the third path, the forefoot region is arranged from the bottom to the top of the article, to include the forefoot cushion; and the top cushion.

Clause 21. The sole structure of clause 20, wherein along the fifth path, the bottom cushion, the heel cushion, and the plate are absent.

Clause 22. A sole structure for an article of footwear, the sole structure comprising a forefoot region disposed adjacent an anterior end; a heel region disposed adjacent a posterior end; a mid-foot region disposed intermediate the forefoot region and the heel region, wherein along a first path of the exterior of the sole structure, the heel region is arranged from a bottom to a top of the article, to include a bottom cushion; a heel cushion; a support plate; and a top cushion.

Clause 23. The sole structure of clause 22, wherein along a second path of the exterior of the sole structure, the mid-foot region is arranged from the bottom to the top of the article, to include the bottom cushion, wherein the bottom cushion includes an exposed upper surface in the mid-foot region when the sole structure is fully assembled; a gap that is open to the external environment, the gap being defined at a bottom end by the exposed upper surface of the bottom cushion; the support plate; and the top cushion.

Clause 24. The sole structure of clause 23, wherein along a third path of the exterior of the sole structure, the forefoot region is arranged from the bottom to the top of the article, to include a forefoot cushion; the support plate; and the top cushion.

Clause 25. The sole structure of clause 24, wherein along a fourth path of the exterior of the sole structure that is posterior to the third path, the forefoot region is arranged from the bottom to the top of the article, to include the bottom cushion; the support plate; and the top cushion.

Clause 26. The sole structure of clause 25, wherein along a fifth path of the exterior of the sole structure that is anterior to the third path, the forefoot region is arranged from the bottom to the top of the article, to include the bottom cushion; and the top cushion.

Clause 27. The sole structure of clause 24, wherein along the second path, the heel cushion and the forefoot cushion are absent.

Clause 28. The sole structure of clause 24, wherein along the third path, the bottom cushion is absent.

Clause 29. The sole structure of clause 25, wherein along the fourth path, the heel cushion and the forefoot cushion are absent.

Clause 30. The sole structure of clause 26, wherein along the fifth path, the bottom cushion, the heel cushion, and the plate are absent.

Clause 31. A sole structure for an article of footwear, the sole structure comprising a forefoot region disposed adjacent an anterior end; a heel region disposed adjacent a posterior end; a mid-foot region disposed intermediate the forefoot region and the heel region, wherein when viewed externally from the article, the mid-foot region is arranged from a bottom to a top of the article, to include a bottom cushion; a gap that is open to the external environment; a support plate; and a top cushion.

Clause 32. The sole structure of clause 31, wherein the bottom cushion includes a fluid-filled bladder.

Clause 33. A sole structure for an article of footwear, the sole structure comprising a fluid-filled bladder extending from a heel region to a forefoot region of the sole structure, wherein the fluid-filled bladder includes an exposed upper surface when the sole structure is in a fully-assembled configuration.

Clause 34. The sole structure of clause 33, wherein the exposed upper surface is not directly connected to any other material.

Clause 35. The sole structure of clause 33, wherein the exposed upper surface is disposed in a midfoot region of the sole structure.

Clause 36. The sole structure of clause 33, wherein the exposed upper surface is visible from a vantage point that is exterior of the sole structure.

Clause 37. A bladder for a sole structure of an article of footwear, the bladder comprising a first segment in a heel region, the first segment containing a fluid-filled hollow interior, the first segment being concave when viewed from a central longitudinal axis of the bladder; a second segment in the heel region disposed on an opposite side of the central longitudinal axis than the first segment, the second segment containing a fluid-filled hollow interior, the segment being concave when viewed from the central longitudinal axis of the bladder; a central support disposed laterally between the first segment and the second segment in the heel region, the central support containing a fluid-filled hollow interior, wherein the central support extends to a midfoot region of bladder, to a position anterior of anterior-most portions of the first segment and the second segment.

Clause 38. The bladder of clause 37, further including a first prong extending from an anterior end of the central support, wherein the first prong has 1) a first section that extends radially outward in the anterior direction, and 2) a second section extending anterior to an anterior end of the first section, wherein the second section is substantially parallel to the central longitudinal axis Clause 39. The bladder of clause 38, further including a second prong extending from an anterior end of the central support, wherein the first prong has 1) a first section that extends radially outward in the anterior direction, and 2) a second section extending anterior to an anterior end of the first section, wherein the second section is substantially parallel to the central longitudinal axis Clause 40. The bladder of clause 37, wherein outer surfaces of the central support are laterally-outermost portions of the bladder in the midfoot region.

Clause 41. The bladder of clause 37, wherein a lateral width of a narrowest portion of the bladder is from about 10% to about 50% of a lateral width of a widest section of the heel region of the sole structure.

Clause 42. The bladder of clause 39, wherein the first segment, the second segment, the central support, the first prong, and the second prong collectively form an interconnected enclosed hollow area containing a fluid.

Clause 43. An article of footwear comprising an upper; and a sole structure, as in one of clauses 1-21, attached to the upper.

Clause 44. An article of footwear comprising an upper; and a sole structure, as in one of clauses 22-30, attached to the upper.

Clause 45. An article of footwear comprising an upper; and a sole structure, as in clause 31 or 32, attached to the upper.

Clause 46. An article of footwear comprising an upper; and a sole structure, as in one of clauses 33-36, attached to the upper.

Clause 47. An article of footwear comprising an upper; and a sole structure attached to the upper, the sole structure including a bottom cushion, a heel cushion, a support plate, and a top cushion.

Clause 48. The article of footwear of clause 46, wherein the bottom cushion extends from a heel region to a forefoot region.

Clause 49. The article of footwear of clause 46, wherein the heel cushion is coupled to a top surface of the bottom cushion in a heel region.

Clause 50. The article of footwear of clause 46, wherein the support plate is coupled to 1) a top surface of the heel cushion in a heel region, and 2) a top surface of the bottom cushion in a forefoot region.

Clause 51. The article of footwear of clause 46, wherein the top cushion is coupled to a top surface of the support plate.

Clause 52. An article of footwear comprising an upper; a sole structure attached to the upper, wherein the sole structure includes a bottom cushion, a heel cushion, a support plate, a top cushion, and a gap; and a heel counter extending around a posterior end of the upper from one or more contact portions to an apex.

Clause 53. An article of footwear comprising an upper; and a sole structure attached to the upper, wherein the sole structure is arranged in a heel region from a bottom to a top of the article of footwear to include: a bottom cushion, a heel cushion, a support plate, and a top cushion.

Clause 54. An article of footwear comprising an upper; and a sole structure attached to the upper, wherein the sole structure is arranged in a mid-foot region from a bottom to a top of the article of footwear to include: a bottom cushion, a gap open to the external environment, a support plate, and a top cushion.

Clause 55. An article of footwear comprising an upper; and a sole structure attached to the upper, wherein the sole structure includes a fluid-filled bladder extending from a heel region to a forefoot region of the sole structure, wherein the fluid-filled bladder includes an exposed upper surface when the sole structure is in a fully-assembled configuration.

Clause 56. An article of footwear comprising an upper; and a sole structure attached to the upper, the sole structure including a bottom cushion, a heel cushion, a support plate, a top cushion, wherein one or more of the bottom cushion, the heel cushion, the support plate, and the top cushion are each formed of one or more different materials.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

We claim:

1. A sole structure for an article of footwear, the sole structure comprising:

a forefoot region disposed adjacent an anterior end;

a heel region disposed adjacent a posterior end;

a bottom cushion extending from the heel region to the forefoot region, wherein the bottom cushion is a fluid-filled bladder having an exposed upper surface when the sole structure is in a fully assembled configuration;

a heel cushion coupled to a top surface of the bottom cushion in the heel region;

a support plate coupled to a) a top surface of the heel cushion in the heel region, and b) a top surface of the bottom cushion in the forefoot region; and a top cushion coupled to a top surface of the support plate.

2. The sole structure of claim 1, wherein the fluid-filled bladder includes:

a first segment in the heel region, the first segment containing a fluid-filled hollow interior, the first segment being concave when viewed from a central longitudinal axis of the bladder; and a second segment in the heel region disposed on an opposite side of the central longitudinal axis than the first segment, the second segment containing a fluid-filled hollow interior, the second segment being concave when viewed from the central longitudinal axis of the bladder.

3. The sole structure of claim 2, wherein the fluid-filled bladder further includes:

a central support disposed laterally between the first segment and the second segment in the heel region, the central support containing a fluid-filled hollow interior, wherein the central support extends to a midfoot region of sole structure, to a position anterior of anterior-most portions of the first segment and the second segment, and wherein outer surfaces of the central support are laterally-outermost portions of the bladder in the mid-foot region.

4. The sole structure of claim 3, wherein the fluid-filled bladder further includes a first prong extending from an anterior end of the central support, wherein the first prong has 1) a first section that extends radially outward in an anterior direction, and 2) a second section extending anterior to an anterior end of the first section, wherein the second section is substantially parallel to the central longitudinal axis.

5. The sole structure of claim 4, wherein the fluid-filled bladder further includes a second prong extending from an anterior end of the central support, wherein the first prong has 1) a first section that extends radially outward in the anterior direction, and 2) a second section extending anterior to an anterior end of the first section, wherein the second section is substantially parallel to the central longitudinal axis, wherein the first prong and the second prong extend in opposite directions relative to the central longitudinal axis.

6. The sole structure of claim 1, wherein the exposed upper surface is not directly connected to any other material.

7. The sole structure of claim 1, wherein the exposed upper surface is disposed in a midfoot region of the sole structure.

8. The sole structure of claim 1, wherein the exposed upper surface is visible from a vantage point that is exterior of the sole structure.

9. The sole structure of claim 1, wherein the exposed upper surface is open to the environment exterior of the article of footwear.

10. The sole structure of claim 1, wherein along a first path of an exterior of the sole structure, the heel region is arranged from a bottom to a top of the article, to include:

a) the bottom cushion;

b) the heel cushion;

c) the support plate; and d) the top cushion.

11. The sole structure of claim 10, wherein along a second path of the exterior of the sole structure, a midfoot region is arranged from the bottom to the top of the article, to include:

e) the bottom cushion, wherein the bottom cushion includes an exposed upper surface in the midfoot region when the sole structure is fully assembled;

f) a gap that is open to the external environment, the gap being defined at a bottom end by the exposed upper surface of the bottom cushion;

g) the support plate; and h) the top cushion.

12. The sole structure of claim 11, wherein along a third path of the exterior of the sole structure, the forefoot region is arranged from the bottom to the top of the article, to include:

a) a forefoot cushion;

b) the support plate; and c) the top cushion.

13. The sole structure of claim 12, wherein along the second path, the heel cushion and the forefoot cushion are absent.

14. The sole structure of claim 12, wherein along the third path, the bottom cushion is absent.

15. The sole structure of claim 12, wherein along a fourth path of the exterior of the sole structure that is posterior to the third path, the forefoot region is arranged from the bottom to the top of the article, to include:

a) the bottom cushion;

b) the support plate; and c) the top cushion.

16. The sole structure of claim 15, wherein along the fourth path, the heel cushion and the forefoot cushion are absent.

17. The sole structure of claim 12, wherein along a fifth path of the exterior of the sole structure that is anterior to the third path, the forefoot region is arranged from the bottom to the top of the article, to include:

a) the forefoot cushion; and b) the top cushion.

18. The sole structure of claim 17, wherein along the fifth path, the bottom cushion, the heel cushion, and the plate are absent.

19. An article of footwear comprising:

an upper; and a sole structure, according to claim 1, attached to the upper.

20. A sole structure for an article of footwear, the sole structure comprising:

a forefoot region disposed adjacent an anterior end;

a heel region disposed adjacent a posterior end, wherein along a first path of the exterior of the sole structure, the heel region is arranged from a bottom to a top of the article, to include:

a) a bottom cushion;

b) a heel cushion;

c) a support plate; and d) a top cushion; and a mid-foot region disposed intermediate the forefoot region and the heel region, the mid-foot region including a gap that is open to the external environment, the gap being defined at a bottom end by an exposed upper surface of the bottom cushion.

21. A sole structure for an article of footwear, the sole structure comprising:

a forefoot region disposed adjacent an anterior end;

a heel region disposed adjacent a posterior end;

a mid-foot region disposed intermediate the forefoot region and the heel region, wherein when viewed externally from the article, the mid-foot region is arranged from a bottom to a top of the article, to include:

a) a bottom cushion;

b) a gap that is open to the external environment, wherein the gap is defined at a bottom end by an exposed upper surface of the bottom cushion;

c) a support plate; and d) a top cushion.

22. An article of footwear comprising:

an upper; and a sole structure, according to claim 20, attached to the upper.

23. An article of footwear comprising:

an upper; and a sole structure, according to claim 21, attached to the upper.

* * * * *